US008400373B2

(12) United States Patent
Yamada

(10) Patent No.: US 8,400,373 B2
(45) Date of Patent: Mar. 19, 2013

(54) DRIVING METHOD OF PLASMA DISPLAY DEVICE

(75) Inventor: Kazuhiro Yamada, Osaka (JP)

(73) Assignee: Panasonic Corporation, Osaka (JP)

( * ) Notice: Subject to any disclaimer, the term of this patent is extended or adjusted under 35 U.S.C. 154(b) by 340 days.

(21) Appl. No.: 12/812,465

(22) PCT Filed: Dec. 10, 2009

(86) PCT No.: PCT/JP2009/006739

§ 371 (c)(1),
(2), (4) Date: Jul. 12, 2010

(87) PCT Pub. No.: WO2010/067601

PCT Pub. Date: Jun. 17, 2010

(65) Prior Publication Data

US 2010/0283775 A1 Nov. 11, 2010

(30) Foreign Application Priority Data

Dec. 11, 2008 (JP) ..... 2008-315356

(51) Int. Cl.
*G09G 3/28* (2006.01)
*G09G 5/10* (2006.01)

(52) U.S. Cl. ..... 345/63; 345/60; 345/690

(58) Field of Classification Search ..... None
See application file for complete search history.

(56) References Cited

U.S. PATENT DOCUMENTS

| | | | | |
|---|---|---|---|---|
| 6,525,702 | B1 | 2/2003 | Van Dijk | |
| 7,071,902 | B1 | 7/2006 | Kawahara | |
| 2002/0158820 | A1 | 10/2002 | Hoppenbrouwers | |
| 2004/0183820 | A1 | 9/2004 | Kawahara et al. | |
| 2005/0225512 | A1 | 10/2005 | Yamada et al. | |
| 2007/0200798 | A1* | 8/2007 | Kim et al. | 345/63 |
| 2007/0262921 | A1* | 11/2007 | Horie et al. | 345/60 |
| 2008/0309591 | A1 | 12/2008 | Shoji et al. | |
| 2011/0227954 | A1* | 9/2011 | Yamada | 345/690 |

FOREIGN PATENT DOCUMENTS

| | | | |
|---|---|---|---|
| CN | 1337037 | A | 2/2002 |
| CN | 1615502 | A | 5/2005 |
| CN | 1720562 | A | 1/2006 |
| CN | 101019163 | A | 8/2007 |
| CN | 101140728 | A | 3/2008 |
| JP | 11-282402 | | 10/1999 |
| JP | 11-282402 | A | 10/1999 |
| JP | 2000-066638 | A | 3/2000 |
| JP | 2001-034229 | A | 2/2001 |

(Continued)

OTHER PUBLICATIONS

International Search Report for International Application No. PCT/JP2009/006739, Mar. 16, 2010, Panasonic Corporation.

*Primary Examiner* — Andrew L Sniezek
(74) *Attorney, Agent, or Firm* — RatnerPrestia

(57) ABSTRACT

The driving method of the plasma display device has a plurality of combination sets for display that include a different number of combinations, and has a random number generating section for generating a random number. For each of a red image signal, a green image signal, and a blue image signal, a combination set for display selected from the plurality of combination sets for display based on a predetermined selection reference is used, and disturbance based on the random number is added to the predetermined selection reference.

6 Claims, 24 Drawing Sheets

FOREIGN PATENT DOCUMENTS

| | | | |
|---|---|---|---|
| JP | 2002-149109 | A | 5/2002 |
| JP | 2004-004800 | A | 1/2004 |
| JP | 2004-021166 | A | 1/2004 |
| JP | 2004-021166 | A | 1/2004 |
| JP | 2005-156890 | A | 6/2005 |
| JP | 2005-156890 | A | 6/2005 |
| JP | 2008-197430 | A | 8/2008 |
| JP | 2008-197430 | A | 8/2008 |

* cited by examiner

FIG. 5A

Gradation for display / Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 0 | 0 | 0 | 0 | 0 | 0 | 0 | 0 | 0 | 0 | 0 | |
| 1 | 1 | 0 | 0 | 0 | 0 | 0 | 0 | 0 | 0 | 0 | 1 |
| 2 | 0 | 1 | 0 | 0 | 0 | 0 | 0 | 0 | 0 | 0 | 2 |
| 3 | 1 | 1 | 0 | 0 | 0 | 0 | 0 | 0 | 0 | 0 | 1 |
| 4 | 1 | 0 | 1 | 0 | 0 | 0 | 0 | 0 | 0 | 0 | 2 |
| 5 | 0 | 1 | 1 | 0 | 0 | 0 | 0 | 0 | 0 | 0 | 2 |
| 6 | 1 | 1 | 1 | 0 | 0 | 0 | 0 | 0 | 0 | 0 | 1 |
| 7 | 1 | 0 | 0 | 1 | 0 | 0 | 0 | 0 | 0 | 0 | 3 |
| 8 | 0 | 1 | 0 | 1 | 0 | 0 | 0 | 0 | 0 | 0 | 2 |
| 9 | 1 | 1 | 0 | 1 | 0 | 0 | 0 | 0 | 0 | 0 | 1 |
| 10 | 1 | 0 | 1 | 1 | 0 | 0 | 0 | 0 | 0 | 0 | 2 |
| 11 | 0 | 1 | 1 | 1 | 0 | 0 | 0 | 0 | 0 | 0 | 2 |
| 12 | 1 | 1 | 1 | 1 | 0 | 0 | 0 | 0 | 0 | 0 | 1 |
| 14 | 1 | 1 | 0 | 0 | 1 | 0 | 0 | 0 | 0 | 0 | 3 |
| 15 | 1 | 0 | 1 | 0 | 1 | 0 | 0 | 0 | 0 | 0 | 2 |
| 16 | 0 | 1 | 1 | 0 | 1 | 0 | 0 | 0 | 0 | 0 | 2 |
| 17 | 1 | 1 | 1 | 0 | 1 | 0 | 0 | 0 | 0 | 0 | 1 |
| 18 | 1 | 0 | 0 | 1 | 1 | 0 | 0 | 0 | 0 | 0 | 3 |
| 19 | 0 | 1 | 0 | 1 | 1 | 0 | 0 | 0 | 0 | 0 | 2 |
| 20 | 1 | 1 | 0 | 1 | 1 | 0 | 0 | 0 | 0 | 0 | 1 |
| 21 | 1 | 0 | 1 | 1 | 1 | 0 | 0 | 0 | 0 | 0 | 2 |
| 22 | 0 | 1 | 1 | 1 | 1 | 0 | 0 | 0 | 0 | 0 | 2 |
| 23 | 1 | 1 | 1 | 1 | 1 | 0 | 0 | 0 | 0 | 0 | 1 |
| 24 | 1 | 1 | 1 | 0 | 0 | 1 | 0 | 0 | 0 | 0 | 3 |
| 25 | 1 | 0 | 0 | 1 | 0 | 1 | 0 | 0 | 0 | 0 | 3 |
| 27 | 1 | 1 | 0 | 1 | 0 | 1 | 0 | 0 | 0 | 0 | 1 |
| 28 | 1 | 0 | 1 | 1 | 0 | 1 | 0 | 0 | 0 | 0 | 2 |
| 30 | 1 | 1 | 1 | 1 | 0 | 1 | 0 | 0 | 0 | 0 | 1 |
| 32 | 1 | 1 | 0 | 0 | 1 | 1 | 0 | 0 | 0 | 0 | 3 |
| 33 | 1 | 0 | 1 | 0 | 1 | 1 | 0 | 0 | 0 | 0 | 2 |
| 35 | 1 | 1 | 1 | 0 | 1 | 1 | 0 | 0 | 0 | 0 | 1 |
| 36 | 1 | 0 | 0 | 1 | 1 | 1 | 0 | 0 | 0 | 0 | 3 |
| 38 | 1 | 1 | 0 | 1 | 1 | 1 | 0 | 0 | 0 | 0 | 1 |
| 39 | 1 | 0 | 1 | 1 | 1 | 1 | 0 | 0 | 0 | 0 | 2 |
| 41 | 1 | 1 | 1 | 1 | 1 | 1 | 0 | 0 | 0 | 0 | 1 |
| 42 | 1 | 1 | 1 | 1 | 0 | [illegible] | [illegible] | [illegible] | [illegible] | [illegible] | [illegible] |

FIG. 5B

Gradation for display / Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 42 | 1 | 1 | 1 | 1 | 0 | 0 | 1 | 0 | 0 | 0 | 3 |
| 44 | 1 | 1 | 0 | 0 | 1 | 0 | 1 | 0 | 0 | 0 | 3 |
| 47 | 1 | 1 | 1 | 0 | 1 | 0 | 1 | 0 | 0 | 0 | 1 |
| 50 | 1 | 1 | 0 | 1 | 1 | 0 | 1 | 0 | 0 | 0 | 2 |
| 53 | 1 | 1 | 1 | 1 | 1 | 0 | 1 | 0 | 0 | 0 | 1 |
| 54 | 1 | 1 | 1 | 0 | 0 | 1 | 1 | 0 | 0 | 0 | 3 |
| 57 | 1 | 1 | 0 | 1 | 0 | 1 | 1 | 0 | 0 | 0 | 2 |
| 60 | 1 | 1 | 1 | 1 | 0 | 1 | 1 | 0 | 0 | 0 | 1 |
| 62 | 1 | 1 | 0 | 0 | 1 | 1 | 1 | 0 | 0 | 0 | 3 |
| 65 | 1 | 1 | 1 | 0 | 1 | 1 | 1 | 0 | 0 | 0 | 1 |
| 68 | 1 | 1 | 0 | 1 | 1 | 1 | 1 | 0 | 0 | 0 | 2 |
| 71 | 1 | 1 | 1 | 1 | 1 | 1 | 1 | 0 | 0 | 0 | 1 |
| 74 | 1 | 1 | 1 | 1 | 0 | 1 | 0 | 1 | 0 | 0 | 3 |
| 76 | 1 | 1 | 0 | 0 | 1 | 1 | 0 | 1 | 0 | 0 | 3 |
| 79 | 1 | 1 | 1 | 0 | 1 | 1 | 0 | 1 | 0 | 0 | 1 |
| 82 | 1 | 1 | 0 | 1 | 1 | 1 | 0 | 1 | 0 | 0 | 2 |
| 85 | 1 | 1 | 1 | 1 | 1 | 1 | 0 | 1 | 0 | 0 | 1 |
| 86 | 1 | 1 | 1 | 1 | 0 | 0 | 1 | 1 | 0 | 0 | 3 |
| 88 | 1 | 1 | 0 | 0 | 1 | 0 | 1 | 1 | 0 | 0 | 3 |
| 91 | 1 | 1 | 1 | 0 | 1 | 0 | 1 | 1 | 0 | 0 | 1 |
| 94 | 1 | 1 | 0 | 1 | 1 | 0 | 1 | 1 | 0 | 0 | 2 |
| 97 | 1 | 1 | 1 | 1 | 1 | 0 | 1 | 1 | 0 | 0 | 1 |
| 98 | 1 | 1 | 1 | 0 | 0 | 1 | 1 | 1 | 0 | 0 | 3 |
| 101 | 1 | 1 | 0 | 1 | 0 | 1 | 1 | 1 | 0 | 0 | 2 |
| 104 | 1 | 1 | 1 | 1 | 0 | 1 | 1 | 1 | 0 | 0 | 1 |
| 106 | 1 | 1 | 0 | 0 | 1 | 1 | 1 | 1 | 0 | 0 | 3 |
| 109 | 1 | 1 | 1 | 0 | 1 | 1 | 1 | 1 | 0 | 0 | 1 |
| 112 | 1 | 1 | 0 | 1 | 1 | 1 | 1 | 1 | 0 | 0 | 2 |
| 115 | 1 | 1 | 1 | 1 | 1 | 1 | 1 | 1 | 0 | 0 | 1 |
| 120 | 1 | 1 | 1 | 1 | 0 | 1 | 1 | 0 | 1 | 0 | 3 |
| 125 | 1 | 1 | 1 | 0 | 1 | 1 | 1 | 0 | 1 | 0 | 2 |
| 131 | 1 | 1 | 1 | 1 | 1 | 1 | 1 | 0 | 1 | 0 | 1 |
| 134 | 1 | 1 | 1 | 1 | 0 | 1 | 0 | 1 | 1 | 0 | 3 |
| 139 | 1 | 1 | 1 | 0 | 1 | 1 | 0 | 1 | 1 | 0 | 2 |
| 145 | 1 | 1 | 1 | 1 | 1 | 1 | 0 | 1 | 1 | 0 | 1 |
| 146 | 1 | 1 | 1 | 1 | 0 | 0 | 1 | 1 | 1 | 0 | 3 |

FIG. 5C

Gradation for display

Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 151 | 1 | 1 | 1 | 0 | 1 | 0 | 1 | 1 | 1 | 0 | 2 |
| 157 | 1 | 1 | 1 | 1 | 1 | 0 | 1 | 1 | 1 | 0 | 1 |
| 158 | 1 | 1 | 1 | 0 | 0 | 1 | 1 | 1 | 1 | 0 | 3 |
| 164 | 1 | 1 | 1 | 1 | 0 | 1 | 1 | 1 | 1 | 0 | 1 |
| 169 | 1 | 1 | 1 | 0 | 1 | 1 | 1 | 1 | 1 | 0 | 2 |
| 175 | 1 | 1 | 1 | 1 | 1 | 1 | 1 | 1 | 1 | 0 | 1 |
| 178 | 1 | 1 | 1 | 1 | 1 | 0 | 1 | 1 | 0 | 1 | 3 |
| 185 | 1 | 1 | 1 | 1 | 0 | 1 | 1 | 1 | 0 | 1 | 2 |
| 196 | 1 | 1 | 1 | 1 | 1 | 1 | 1 | 1 | 0 | 1 | 1 |
| 201 | 1 | 1 | 1 | 1 | 0 | 1 | 1 | 0 | 1 | 1 | 3 |
| 212 | 1 | 1 | 1 | 1 | 1 | 1 | 1 | 0 | 1 | 1 | 1 |
| 215 | 1 | 1 | 1 | 1 | 0 | 1 | 0 | 1 | 1 | 1 | 3 |
| 226 | 1 | 1 | 1 | 1 | 1 | 1 | 0 | 1 | 1 | 1 | 1 |
| 227 | 1 | 1 | 1 | 1 | 0 | 0 | 1 | 1 | 1 | 1 | 3 |
| 238 | 1 | 1 | 1 | 1 | 1 | 0 | 1 | 1 | 1 | 1 | 1 |
| 245 | 1 | 1 | 1 | 1 | 0 | 1 | 1 | 1 | 1 | 1 | 2 |
| 247 | 1 | 1 | 0 | 0 | 1 | 1 | 1 | 1 | 1 | 1 | 3 |
| 248 | 1 | 0 | 1 | 0 | 1 | 1 | 1 | 1 | 1 | 1 | 2 |
| 256 | 1 | 1 | 1 | 1 | 1 | 1 | 1 | 1 | 1 | 1 | 2 |

FIG.5D

Gradation for display

Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 0 | 0 | 0 | 0 | 0 | 0 | 0 | 0 | 0 | 0 | 0 | |
| 1 | 1 | 0 | 0 | 0 | 0 | 0 | 0 | 0 | 0 | 0 | 1 |
| 3 | 1 | 1 | 0 | 0 | 0 | 0 | 0 | 0 | 0 | 0 | 1 |
| 6 | 1 | 1 | 1 | 0 | 0 | 0 | 0 | 0 | 0 | 0 | 1 |
| 12 | 1 | 1 | 1 | 1 | 0 | 0 | 0 | 0 | 0 | 0 | 1 |
| 23 | 1 | 1 | 1 | 1 | 1 | 0 | 0 | 0 | 0 | 0 | 1 |
| 41 | 1 | 1 | 1 | 1 | 1 | 1 | 0 | 0 | 0 | 0 | 1 |
| 71 | 1 | 1 | 1 | 1 | 1 | 1 | 1 | 0 | 0 | 0 | 1 |
| 115 | 1 | 1 | 1 | 1 | 1 | 1 | 1 | 1 | 0 | 0 | 1 |
| 175 | 1 | 1 | 1 | 1 | 1 | 1 | 1 | 1 | 1 | 0 | 1 |
| 256 | 1 | 1 | 1 | 1 | 1 | 1 | 1 | 1 | 1 | 1 | 1 |

FIG. 10A

Gradation for display / Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 0 | 0 | 0 | 0 | 0 | 0 | 0 | 0 | 0 | 0 | 0 | |
| 1 | 1 | 0 | 0 | 0 | 0 | 0 | 0 | 0 | 0 | 0 | 1 |
| 2 | 0 | 1 | 0 | 0 | 0 | 0 | 0 | 0 | 0 | 0 | 2 |
| 3 | 1 | 1 | 0 | 0 | 0 | 0 | 0 | 0 | 0 | 0 | 1 |
| 4 | 1 | 0 | 1 | 0 | 0 | 0 | 0 | 0 | 0 | 0 | 2 |
| 5 | 0 | 1 | 1 | 0 | 0 | 0 | 0 | 0 | 0 | 0 | 2 |
| 6 | 1 | 1 | 1 | 0 | 0 | 0 | 0 | 0 | 0 | 0 | 1 |
| 7 | 1 | 0 | 0 | 1 | 0 | 0 | 0 | 0 | 0 | 0 | 3 |
| 8 | 0 | 1 | 0 | 1 | 0 | 0 | 0 | 0 | 0 | 0 | 2 |
| 9 | 1 | 1 | 0 | 1 | 0 | 0 | 0 | 0 | 0 | 0 | 1 |
| 10 | 1 | 0 | 1 | 1 | 0 | 0 | 0 | 0 | 0 | 0 | 2 |
| 11 | 0 | 1 | 1 | 1 | 0 | 0 | 0 | 0 | 0 | 0 | 2 |
| 12 | 1 | 1 | 1 | 1 | 0 | 0 | 0 | 0 | 0 | 0 | 1 |
| 14 | 1 | 1 | 0 | 0 | 1 | 0 | 0 | 0 | 0 | 0 | 3 |
| 15 | 1 | 0 | 1 | 0 | 1 | 0 | 0 | 0 | 0 | 0 | 2 |
| 16 | 0 | 1 | 1 | 0 | 1 | 0 | 0 | 0 | 0 | 0 | 2 |
| 17 | 1 | 1 | 1 | 0 | 1 | 0 | 0 | 0 | 0 | 0 | 1 |
| 18 | 1 | 0 | 0 | 1 | 1 | 0 | 0 | 0 | 0 | 0 | 3 |
| 19 | 0 | 1 | 0 | 1 | 1 | 0 | 0 | 0 | 0 | 0 | 2 |
| 20 | 1 | 1 | 0 | 1 | 1 | 0 | 0 | 0 | 0 | 0 | 1 |
| 21 | 1 | 0 | 1 | 1 | 1 | 0 | 0 | 0 | 0 | 0 | 2 |
| 22 | 0 | 1 | 1 | 1 | 1 | 0 | 0 | 0 | 0 | 0 | 2 |
| 23 | 1 | 1 | 1 | 1 | 1 | 0 | 0 | 0 | 0 | 0 | 1 |
| 24 | 1 | 1 | 1 | 0 | 0 | 1 | 0 | 0 | 0 | 0 | 3 |
| 25 | 1 | 0 | 0 | 1 | 0 | 1 | 0 | 0 | 0 | 0 | 3 |
| 27 | 1 | 1 | 0 | 1 | 0 | 1 | 0 | 0 | 0 | 0 | 1 |
| 28 | 1 | 0 | 1 | 1 | 0 | 1 | 0 | 0 | 0 | 0 | 2 |
| 30 | 1 | 1 | 1 | 1 | 0 | 1 | 0 | 0 | 0 | 0 | 1 |
| 32 | 1 | 1 | 0 | 0 | 1 | 1 | 0 | 0 | 0 | 0 | 3 |
| 33 | 1 | 0 | 1 | 0 | 1 | 1 | 0 | 0 | 0 | 0 | 2 |
| 35 | 1 | 1 | 1 | 0 | 1 | 1 | 0 | 0 | 0 | 0 | 1 |
| 36 | 1 | 0 | 0 | 1 | 1 | 1 | 0 | 0 | 0 | 0 | 3 |
| 38 | 1 | 1 | 0 | 1 | 1 | 1 | 0 | 0 | 0 | 0 | 1 |
| 39 | 1 | 0 | 1 | 1 | 1 | 1 | 0 | 0 | 0 | 0 | 2 |
| 41 | 1 | 1 | 1 | 1 | 1 | 1 | 0 | 0 | 0 | 0 | 1 |
| 42 | 1 | 1 | 1 | 1 | 0 | 0 | 1 | 0 | 0 | 0 | 3 |

FIG. 10B

Gradation for display / Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 44 | 1 | 1 | 0 | 0 | 1 | 0 | 1 | 0 | 0 | 0 | 3 |
| 47 | 1 | 1 | 1 | 0 | 1 | 0 | 1 | 0 | 0 | 0 | 1 |
| 50 | 1 | 1 | 0 | 1 | 1 | 0 | 1 | 0 | 0 | 0 | 2 |
| 53 | 1 | 1 | 1 | 1 | 1 | 0 | 1 | 0 | 0 | 0 | 1 |
| 54 | 1 | 1 | 1 | 0 | 0 | 1 | 1 | 0 | 0 | 0 | 3 |
| 57 | 1 | 1 | 0 | 1 | 0 | 1 | 1 | 0 | 0 | 0 | 2 |
| 60 | 1 | 1 | 1 | 1 | 0 | 1 | 1 | 0 | 0 | 0 | 1 |
| [illegible] | 1 | 1 | 0 | 0 | [illegible] | [illegible] | [illegible] | [illegible] | [illegible] | [illegible] | [illegible] |
| 158 | 1 | 1 | 1 | 0 | 0 | 1 | 1 | 1 | 1 | 0 | 3 |
| 164 | 1 | 1 | 1 | 1 | 0 | 1 | 1 | 1 | 1 | 0 | 1 |
| 169 | 1 | 1 | 1 | 0 | 1 | 1 | 1 | 1 | 1 | 0 | 2 |
| 175 | 1 | 1 | 1 | 1 | 1 | 1 | 1 | 1 | 1 | 0 | 1 |
| 178 | 1 | 1 | 1 | 1 | 1 | 0 | 1 | 1 | 0 | 1 | 3 |
| 185 | 1 | 1 | 1 | 1 | 0 | 1 | 1 | 1 | 0 | 1 | 2 |
| 196 | 1 | 1 | 1 | 1 | 1 | 1 | 1 | 1 | 0 | 1 | 1 |
| 201 | 1 | 1 | 1 | 1 | 0 | 1 | 1 | 0 | 1 | 1 | 3 |
| 212 | 1 | 1 | 1 | 1 | 1 | 1 | 1 | 0 | 1 | 1 | 1 |
| 215 | 1 | 1 | 1 | 1 | 0 | 1 | 0 | 1 | 1 | 1 | 3 |
| 226 | 1 | 1 | 1 | 1 | 1 | 1 | 0 | 1 | 1 | 1 | 1 |
| 227 | 1 | 1 | 1 | 1 | 0 | 0 | 1 | 1 | 1 | 1 | 3 |
| 238 | 1 | 1 | 1 | 1 | 1 | 0 | 1 | 1 | 1 | 1 | 1 |
| 245 | 1 | 1 | 1 | 1 | 0 | 1 | 1 | 1 | 1 | 1 | 2 |
| 247 | 1 | 1 | 0 | 0 | 1 | 1 | 1 | 1 | 1 | 1 | 3 |
| 248 | 1 | 0 | 1 | 0 | 1 | 1 | 1 | 1 | 1 | 1 | 2 |
| 256 | 1 | 1 | 1 | 1 | 1 | 1 | 1 | 1 | 1 | 1 | 2 |

FIG. 10C

Gradation for display / Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 0 | 0 | 0 | 0 | 0 | 0 | 0 | 0 | 0 | 0 | 0 | |
| 1 | 1 | 0 | 0 | 0 | 0 | 0 | 0 | 0 | 0 | 0 | 1 |
| 2 | 0 | 1 | 0 | 0 | 0 | 0 | 0 | 0 | 0 | 0 | 2 |
| 3 | 1 | 1 | 0 | 0 | 0 | 0 | 0 | 0 | 0 | 0 | 1 |
| 4 | 1 | 0 | 1 | 0 | 0 | 0 | 0 | 0 | 0 | 0 | 2 |
| 5 | 0 | 1 | 1 | 0 | 0 | 0 | 0 | 0 | 0 | 0 | 2 |
| 6 | 1 | 1 | 1 | 0 | 0 | 0 | 0 | 0 | 0 | 0 | 1 |
| 9 | 1 | 1 | 0 | 1 | 0 | 0 | 0 | 0 | 0 | 0 | 2 |
| 10 | 1 | 0 | 1 | 1 | 0 | 0 | 0 | 0 | 0 | 0 | 2 |
| 11 | 0 | 1 | 1 | 1 | 0 | 0 | 0 | 0 | 0 | 0 | 2 |
| 12 | 1 | 1 | 1 | 1 | 0 | 0 | 0 | 0 | 0 | 0 | 1 |
| 17 | 1 | 1 | 1 | 0 | 1 | 0 | 0 | 0 | 0 | 0 | 2 |
| 20 | 1 | 1 | 0 | 1 | 1 | 0 | 0 | 0 | 0 | 0 | 2 |
| 21 | 1 | 0 | 1 | 1 | 1 | 0 | 0 | 0 | 0 | 0 | 2 |
| 22 | 0 | 1 | 1 | 1 | 1 | 0 | 0 | 0 | 0 | 0 | 2 |
| 23 | 1 | 1 | 1 | 1 | 1 | 0 | 0 | 0 | 0 | 0 | 1 |
| 30 | 1 | 1 | 1 | 1 | 0 | 1 | 0 | 0 | 0 | 0 | 2 |
| 35 | 1 | 1 | 1 | 0 | 1 | 1 | 0 | 0 | 0 | 0 | 2 |
| 38 | 1 | 1 | 0 | 1 | 1 | 1 | 0 | 0 | 0 | 0 | 2 |
| 39 | 1 | 0 | 1 | 1 | 1 | 1 | 0 | 0 | 0 | 0 | 2 |
| 41 | 1 | 1 | 1 | 1 | 1 | 1 | 0 | 0 | 0 | 0 | 1 |
| 53 | 1 | 1 | 1 | 1 | 1 | 0 | 1 | 0 | 0 | 0 | 2 |
| 60 | 1 | 1 | 1 | 1 | 0 | 1 | 1 | 0 | 0 | 0 | 2 |
| 65 | 1 | 1 | 1 | 0 | 1 | 1 | 1 | 0 | 0 | 0 | 2 |
| 68 | 1 | 1 | 0 | 1 | 1 | 1 | 1 | 0 | 0 | 0 | 2 |
| 71 | 1 | 1 | 1 | 1 | 1 | 1 | 1 | 0 | 0 | 0 | 1 |
| 85 | 1 | 1 | 1 | 1 | 1 | 1 | 0 | 1 | 0 | 0 | 2 |
| 97 | 1 | 1 | 1 | 1 | 1 | 0 | 1 | 1 | 0 | 0 | 2 |
| 104 | 1 | 1 | 1 | 1 | 0 | 1 | 1 | 1 | 0 | 0 | 2 |
| 109 | 1 | 1 | 1 | 0 | 1 | 1 | 1 | 1 | 0 | 0 | 2 |
| 112 | 1 | 1 | 0 | 1 | 1 | 1 | 1 | 1 | 0 | 0 | 2 |
| 115 | 1 | 1 | 1 | 1 | 1 | 1 | 1 | 1 | 0 | 0 | 1 |
| 131 | 1 | 1 | 1 | 1 | 1 | 1 | 1 | 0 | 1 | 0 | 2 |
| 145 | 1 | 1 | 1 | 1 | 1 | 1 | 0 | 1 | 1 | 0 | 2 |
| 157 | 1 | 1 | 1 | 1 | 1 | 0 | 1 | 1 | 1 | 0 | 2 |

FIG. 10D

Gradation for display

Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 164 | 1 | 1 | 1 | 1 | 0 | 1 | 1 | 1 | 1 | 0 | 2 |
| 169 | 1 | 1 | 1 | 0 | 1 | 1 | 1 | 1 | 1 | 0 | 2 |
| 175 | 1 | 1 | 1 | 1 | 1 | 1 | 1 | 1 | 1 | 0 | 1 |
| 196 | 1 | 1 | 1 | 1 | 1 | 1 | 1 | 1 | 0 | 1 | 2 |
| 212 | 1 | 1 | 1 | 1 | 1 | 1 | 1 | 0 | 1 | 1 | 2 |
| 226 | 1 | 1 | 1 | 1 | 1 | 1 | 0 | 1 | 1 | 1 | 2 |
| 238 | 1 | 1 | 1 | 1 | 1 | 0 | 1 | 1 | 1 | 1 | 2 |
| 245 | 1 | 1 | 1 | 1 | 0 | 1 | 1 | 1 | 1 | 1 | 2 |
| 256 | 1 | 1 | 1 | 1 | 1 | 1 | 1 | 1 | 1 | 1 | 1 |

FIG. 10E

Gradation for display

Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 0 | 0 | 0 | 0 | 0 | 0 | 0 | 0 | 0 | 0 | 0 | |
| 1 | 1 | 0 | 0 | 0 | 0 | 0 | 0 | 0 | 0 | 0 | 1 |
| 2 | 0 | 1 | 0 | 0 | 0 | 0 | 0 | 0 | 0 | 0 | 2 |
| 3 | 1 | 1 | 0 | 0 | 0 | 0 | 0 | 0 | 0 | 0 | 1 |
| 4 | 1 | 0 | 1 | 0 | 0 | 0 | 0 | 0 | 0 | 0 | 2 |
| 6 | 1 | 1 | 1 | 0 | 0 | 0 | 0 | 0 | 0 | 0 | 1 |
| 9 | 1 | 1 | 0 | 1 | 0 | 0 | 0 | 0 | 0 | 0 | 2 |
| 12 | 1 | 1 | 1 | 1 | 0 | 0 | 0 | 0 | 0 | 0 | 1 |
| 17 | 1 | 1 | 1 | 0 | 1 | 0 | 0 | 0 | 0 | 0 | 2 |
| 23 | 1 | 1 | 1 | 1 | 1 | 0 | 0 | 0 | 0 | 0 | 1 |
| 30 | 1 | 1 | 1 | 1 | 0 | 1 | 0 | 0 | 0 | 0 | 2 |
| 41 | 1 | 1 | 1 | 1 | 1 | 1 | 0 | 0 | 0 | 0 | 1 |
| 53 | 1 | 1 | 1 | 1 | 1 | 0 | 1 | 0 | 0 | 0 | 2 |
| 71 | 1 | 1 | 1 | 1 | 1 | 1 | 1 | 0 | 0 | 0 | 1 |
| 85 | 1 | 1 | 1 | 1 | 1 | 1 | 0 | 1 | 0 | 0 | 2 |
| 115 | 1 | 1 | 1 | 1 | 1 | 1 | 1 | 1 | 0 | 0 | 1 |
| 131 | 1 | 1 | 1 | 1 | 1 | 1 | 1 | 0 | 1 | 0 | 2 |
| 175 | 1 | 1 | 1 | 1 | 1 | 1 | 1 | 1 | 1 | 0 | 1 |
| 196 | 1 | 1 | 1 | 1 | 1 | 1 | 1 | 1 | 0 | 1 | 2 |
| 256 | 1 | 1 | 1 | 1 | 1 | 1 | 1 | 1 | 1 | 1 | 1 |

FIG. 10F

Gradation for display

Hamming distance

| | SF1 (1) | SF2 (2) | SF3 (3) | SF4 (6) | SF5 (11) | SF6 (18) | SF7 (30) | SF8 (44) | SF9 (60) | SF10 (81) | |
|---|---|---|---|---|---|---|---|---|---|---|---|
| 0 | 0 | 0 | 0 | 0 | 0 | 0 | 0 | 0 | 0 | 0 | |
| 1 | 1 | 0 | 0 | 0 | 0 | 0 | 0 | 0 | 0 | 0 | 1 |
| 3 | 1 | 1 | 0 | 0 | 0 | 0 | 0 | 0 | 0 | 0 | 1 |
| 6 | 1 | 1 | 1 | 0 | 0 | 0 | 0 | 0 | 0 | 0 | 1 |
| 12 | 1 | 1 | 1 | 1 | 0 | 0 | 0 | 0 | 0 | 0 | 1 |
| 23 | 1 | 1 | 1 | 1 | 1 | 0 | 0 | 0 | 0 | 0 | 1 |
| 41 | 1 | 1 | 1 | 1 | 1 | 1 | 0 | 0 | 0 | 0 | 1 |
| 71 | 1 | 1 | 1 | 1 | 1 | 1 | 1 | 0 | 0 | 0 | 1 |
| 115 | 1 | 1 | 1 | 1 | 1 | 1 | 1 | 1 | 0 | 0 | 1 |
| 175 | 1 | 1 | 1 | 1 | 1 | 1 | 1 | 1 | 1 | 0 | 1 |
| 256 | 1 | 1 | 1 | 1 | 1 | 1 | 1 | 1 | 1 | 1 | 1 |

FIG. 12

| Dark image/bright image | Relative signal level | Spatial difference | Moving image/still image | R table | G table | B table |
|---|---|---|---|---|---|---|
| Dark | – | – | – | First | First | First |
| Bright | High | Small | Still | First | First | First |
| Bright | High | Small | Moving | Second | Second | Second |
| Bright | High | Large | – | Fourth | Third | Fourth |
| Bright | Intermediate | Small | – | Third | Third | Third |
| Bright | Intermediate | Large | – | Fourth | Third | Fourth |
| Bright | Low | – | – | Fourth | Fourth | Fourth |

DRIVING METHOD OF PLASMA DISPLAY DEVICE

THIS APPLICATION IS A U.S. NATIONAL PHASE APPLICATION OF PCT INTERNATIONAL APPLICATION PCT/JP2009/006739.

TECHNICAL FIELD

The present invention relates to a driving method of a plasma display device using an alternating-current (AC) type plasma display panel.

BACKGROUND ART

A plasma display panel (hereinafter referred to as "panel") typical as an image display device that has many pixels arranged in a plane shape has many discharge cells that have a scan electrode, a sustain electrode, and a data electrode. The panel excites a phosphor to emit light with gas discharge that is generated inside each discharge cell, and performs color display.

A plasma display device using such a panel mainly employs a subfield method as a method of displaying an image. In this method, one field period is formed of a plurality of subfields having a predetermined luminance weight, and an image is displayed by controlling light emission or no light emission in each discharge cell in each subfield.

The plasma display device has a scan electrode driving circuit for driving a scan electrode, a sustain electrode driving circuit for driving a sustain electrode, and a data electrode driving circuit for driving a data electrode. The driving circuit of each electrode of the plasma display device applies a required driving voltage waveform to each electrode. The data electrode driving circuit, based on an image signal, independently applies an address pulse for address operation to each of many data electrodes.

When the panel is seen from the side of the data electrode driving circuit, each data electrode serves as a capacitive load having a stray capacitance between it and an adjacent data electrode, scan electrode, and sustain electrode. Therefore, in order to apply a driving voltage waveform to each data electrode, charge and discharge of this capacitance must be required. As a result, the data electrode driving circuit requires power consumption for the charge and discharge.

The power consumption of the data electrode driving circuit increases as charge/discharge current of the capacitance possessed by the data electrode increases. This charge/discharge current largely depends on an image signal to be displayed. For instance, when an address pulse is applied to no data electrode, the charge/discharge current becomes "0" and hence the power consumption becomes minimum. Also when an address pulse is applied to all data electrodes, the charge/discharge current becomes "0" and hence the power consumption is small. When an address pulse is applied to data electrodes in a random fashion, the charge/discharge current becomes large and hence the power consumption also becomes large.

As a method of reducing the power consumption of the data electrode driving circuit, the following method or the like is disclosed. In this method, the power consumption of the data electrode driving circuit is calculated based on an image signal, for example. When the power consumption is large, an address operation is prohibited firstly in the subfield of the smallest luminance weight to restrict the power consumption of the data electrode driving circuit (for example, patent literature 1). Alternatively, a method or the like of decreasing the power consumption of the data electrode driving circuit by replacing the original image signal with an image signal for decreasing the power consumption of the data electrode driving circuit is disclosed (for example, patent literature 2).

The methods of patent literatures 1 and 2 are mainly used for preventing the plasma display device from failing when the power consumption excessively increases. Therefore, these methods can largely reduce the image display quality.

Recently, the power consumption of the data electrode driving circuit has steadily increased in response to enlargement in screen and enhancement in definition. Therefore, a power reducing method capable of being steadily used without sacrificing the image display quality has been demanded.

Citation List

[Patent Literature]

[Patent Literature 1] Unexamined Japanese Patent Publication No. 2000-66638

[Patent Literature 2] Unexamined Japanese Patent Publication No. 2002-149109

SUMMARY OF THE INVENTION

A driving method of a plasma display device of the present invention has the following steps:

constituting one field period by a plurality of subfields having a predetermined luminance weight;

selecting a plurality of combinations from arbitrary combinations of the subfields and creating a combination set for display; and displaying gradation by controlling the light emission or no light emission in a discharge cell using a combination of the subfields belonging to the combination set for display.

The driving method of the plasma display device has the following steps. A plurality of combination sets for display having a different number of combinations is provided, and a random number generating section for generating a random number is provided. For each of a red image signal, a green image signal, and a blue image signal, a combination set for display selected from the plurality of combination sets for display based on a predetermined selection reference is used. Disturbance based on the random number is added to a predetermined selection reference.

This method can provide a driving method of the plasma display device capable of reducing the power consumption of the data electrode driving circuit without sacrificing the image display quality.

The predetermined selection reference for the red image signal of the present invention may be the ratio of the signal level of the red image signal to the signal level of the green image signal.

The predetermined selection reference for the green image signal of the present invention may be the ratio of the signal level of the green image signal to the higher one of the signal levels of the red image signal and the blue image signal.

The predetermined selection reference for the blue image signal of the present invention may be the ratio of the signal level of the blue image signal to the signal level of the green image signal.

The predetermined selection reference for the image signal of each color, of the red image signal, the green image signal, and the blue image signal of the present invention, may be the ratio of the absolute value of the spatial difference for the image signal of the color to the signal level of the image signal of the color.

The average value of hamming distances between certain gradations and the next smaller gradations in a combination set for display that has a small number of combinations is smaller than that in a combination set for display that has a large number of combinations.

BRIEF DESCRIPTION OF DRAWINGS

FIG. 5A is a diagram showing a coding table used in the plasma display device.

FIG. 5B is a diagram showing another coding table used in the plasma display device.

FIG. 5C is a diagram showing yet another coding table used in the plasma display device.

FIG. 5D is a diagram showing still another coding table used in the plasma display device.

FIG. 10A is a diagram showing a coding table used in a plasma display device in accordance with a second exemplary embodiment of the present invention.

FIG. 10B is a diagram showing another coding table used in the plasma display device in accordance with the second exemplary embodiment.

FIG. 10C is a diagram showing yet another coding table used in the plasma display device in accordance with the second exemplary embodiment.

FIG. 10D is a diagram showing still another coding table used in the plasma display device in accordance with the second exemplary embodiment.

FIG. 10E is a diagram showing still another coding table used in the plasma display device in accordance with the second exemplary embodiment.

FIG. 10F is a diagram showing still another coding table used in the plasma display device in accordance with the second exemplary embodiment.

FIG. 12 is a diagram showing the selective use of the coding tables for an image signal of the plasma display device.

DETAILED DESCRIPTION OF PREFERRED EMBODIMENTS (First Exemplary Embodiment)

Figure 1:
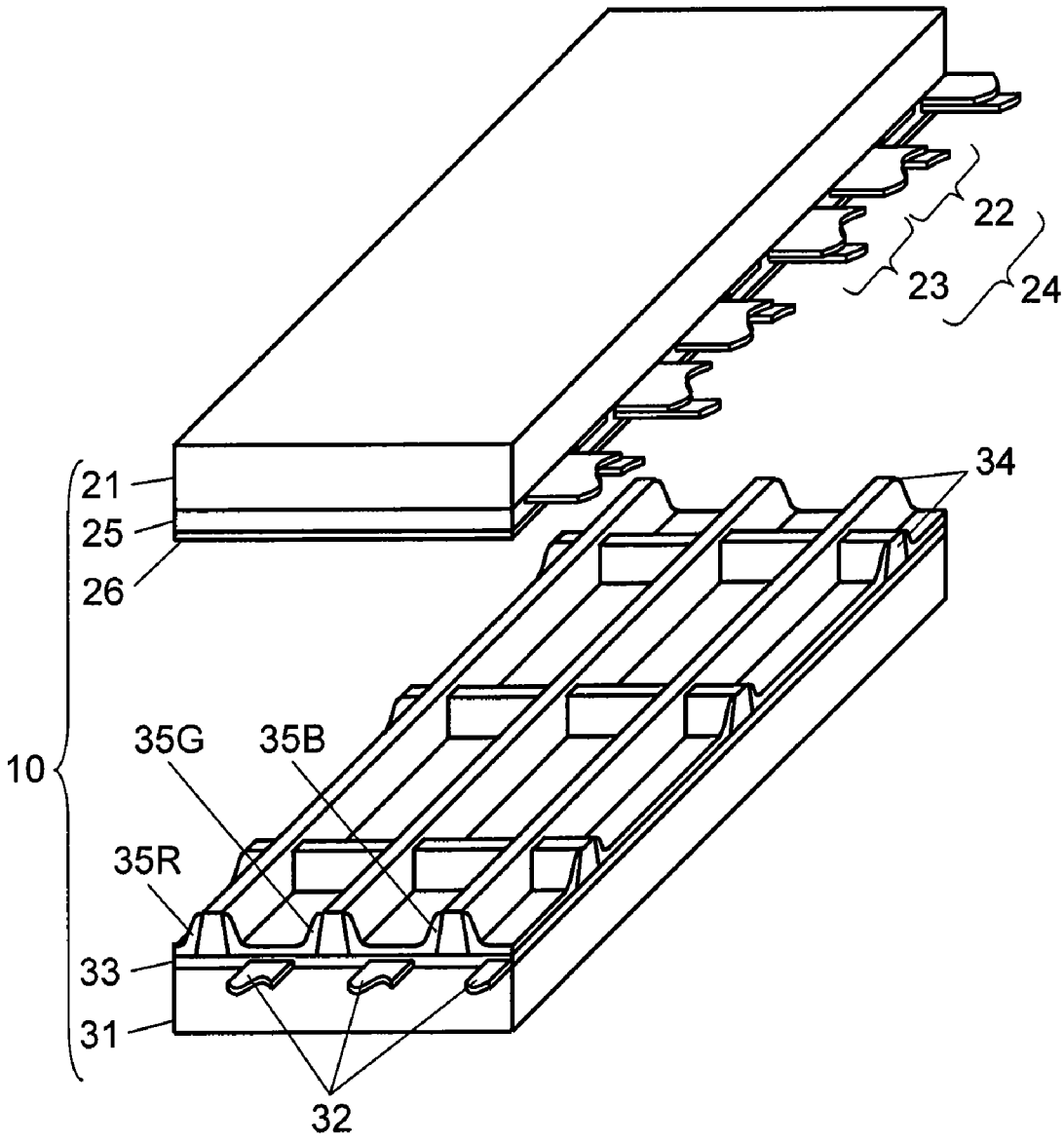
FIG. 1 is an exploded perspective view showing a structure of a panel of a plasma display device in accordance with a first exemplary embodiment of the present invention.

Plasma display devices in accordance with exemplary embodiments of the present invention will be described hereinafter with reference to the accompanying drawings. FIG. 1 is an exploded perspective view showing a structure of panel 10 of the plasma display device in accordance with the first exemplary embodiment of the present invention. A plurality of display electrode pairs 24 formed of scan electrodes 22 and sustain electrodes 23 is disposed on glass-made front substrate 21. Dielectric layer 25 is formed so as to cover display electrode pairs 24, and protective layer 26 is formed on dielectric layer 25. A plurality of data electrodes 32 is formed on rear substrate 31, dielectric layer 33 is formed so as to cover data electrodes 32, and mesh barrier ribs 34 are formed on dielectric layer 33. Phosphor layer 35R for emitting red light, phosphor layer 35G for emitting green light, and phosphor layer 35B for emitting blue light are formed on the side surfaces of barrier ribs 34 and on dielectric layer 33.

Front substrate 21 and rear substrate 31 are faced to each other so that display electrode pairs 24 cross data electrodes 32 with a micro discharge space sandwiched between them, and the outer peripheries of them are sealed by a sealing material such as glass frit. The discharge space is filled with mixed gas of neon and xenon as discharge gas, for example. The discharge space is partitioned into a plurality of sections by barrier ribs 34. Discharge cells are formed in the intersecting parts of display electrode pairs 24 and data electrodes 32. The discharge cells discharge and emit light to display an image.

The structure of panel 10 is not limited to the above-mentioned one, but may have striped barrier ribs, for example.

Figure 2:
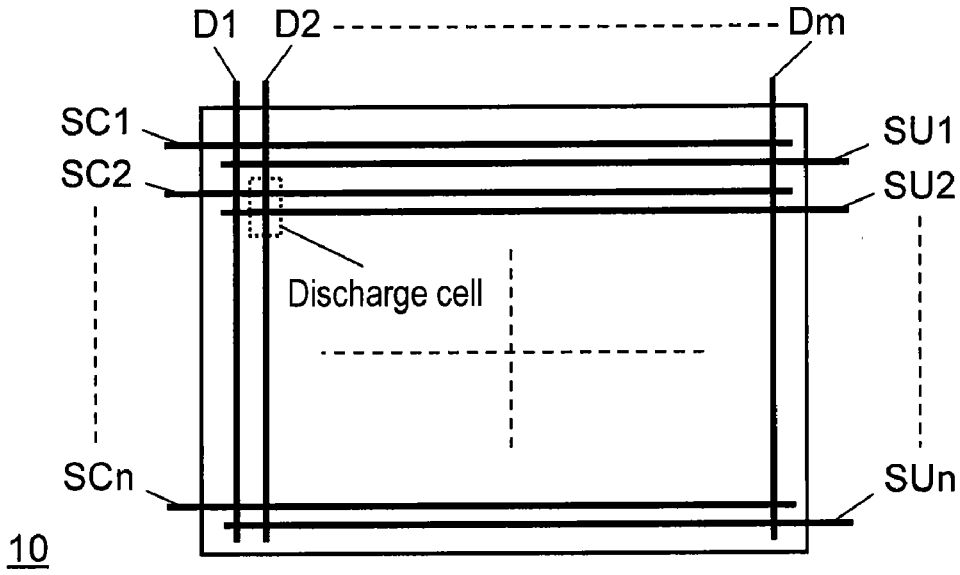
FIG. 2 is an electrode array diagram of the plasma display device.

FIG. 2 is an electrode array diagram of panel 10 of the plasma display device in accordance with the first exemplary embodiment of the present invention. Panel 10 has n scan electrodes SC1 through SCn (scan electrodes 22 in FIG. 1) and n sustain electrodes SU1 through SUn (sustain electrodes 23 in FIG. 1) both extended in the row direction, and m data electrodes D1 through Dm (data electrodes 32 in FIG. 1) extended in the column direction. A discharge cell is formed in the part where a pair of scan electrode SCi (i is 1 through n) and sustain electrode SUi intersect with one data electrode Dj (j is 1 through m). Thus, m×n discharge cells are formed in the discharge space. Three adjacent discharge cells, which are a discharge cell having red phosphor layer 35R, a discharge cell having green phosphor layer 35G, and a discharge cell having blue phosphor layer 35B, correspond to one pixel when an image is displayed. Therefore, m/3×n sets of pixels are formed on panel 10. A pixel at a pixel position (x, y) on the display screen is constituted by three discharge cells formed in parts where scan electrodes SCy and sustain electrodes SUy intersect with three data electrodes D3*x*−2, D3*x*−1, and D3*x*. Here, x is 1 to m/3 and y is 1 to n.

Figure 3:
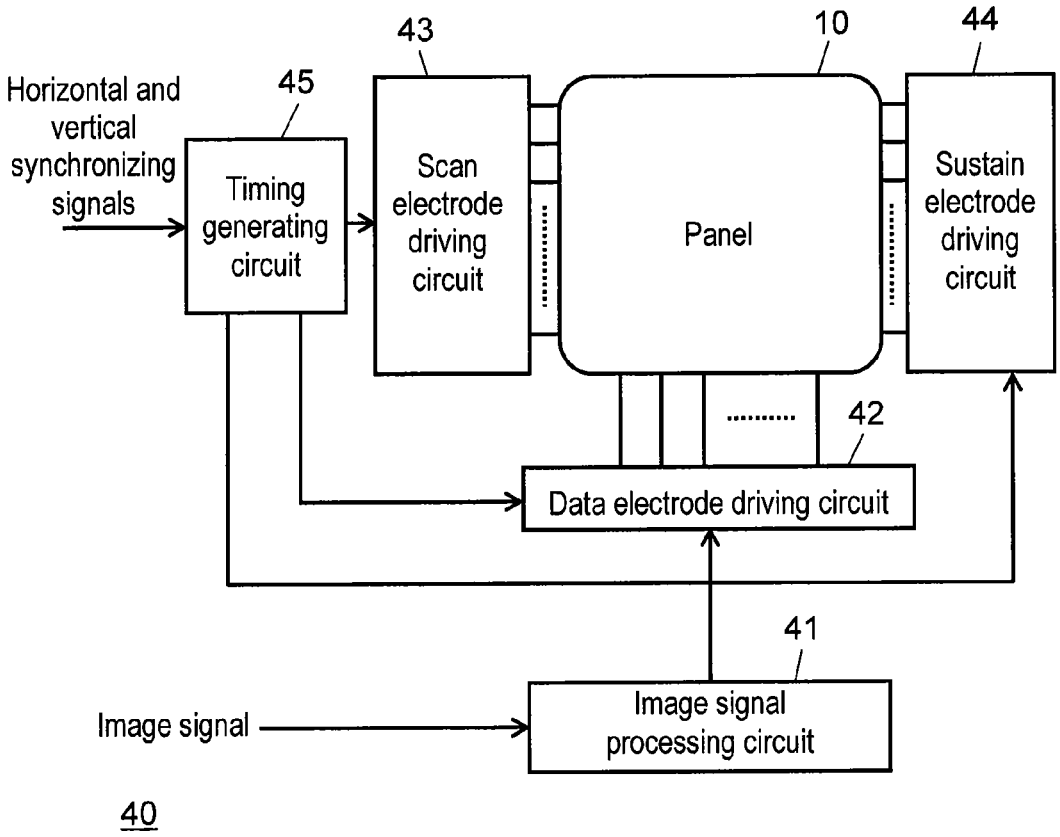
FIG. 3 is a circuit block diagram of the plasma display device.

FIG. 3 is a circuit block diagram of plasma display device 40 in accordance with the first exemplary embodiment of the present invention. Plasma display device 40 has the following elements:

panel 10;
image signal processing circuit 41;
data electrode driving circuit 42;
scan electrode driving circuit 43;
sustain electrode driving circuit 44;
timing generating circuit 45; and a power supply circuit (not shown) for supplying power required for each circuit block.

Image signal processing circuit 41 converts an input image signal into an image signal of each color having the number of pixel and the number of gradation that allow the display thereof on panel 10 (the detail is described later). Image signal processing circuit 41 converts the light emission and no light emission of a discharge cell in each subfield into image data of each color corresponding to bits "1" and "0" of a digital signal.

Data electrode driving circuit 42 converts the image data output from image signal processing circuit 41 into an address pulse corresponding to each of data electrodes D1 through Dm, and applies the address pulse to each of data electrodes D1 through Dm.

Timing generating circuit 45 generates various timing signals for controlling operations of respective circuit blocks based on a horizontal synchronizing signal and a vertical synchronizing signal, and supplies them to respective circuit blocks. Scan electrode driving circuit 43 and sustain electrode driving circuit 44 generate driving voltage waveforms based on respective timing signals, and apply the waveforms to scan electrodes SC1 through SCn and sustain electrodes SU1 through SUn.

Next, driving voltage waveforms and operation for driving panel 10 are described. In the present embodiment, one field is divided into 10 subfields (SF1, SF2, SF10), and respective subfields have luminance weights of 1, 2, 3, 6, 11, 18, 30, 44, 60, and 81. In the present embodiment, thus, a later subfield is set to have a larger luminance weight. In the present invention, however, the number of subfield and the luminance weight of each subfield are not limited to the above-mentioned values.

Figure 4:
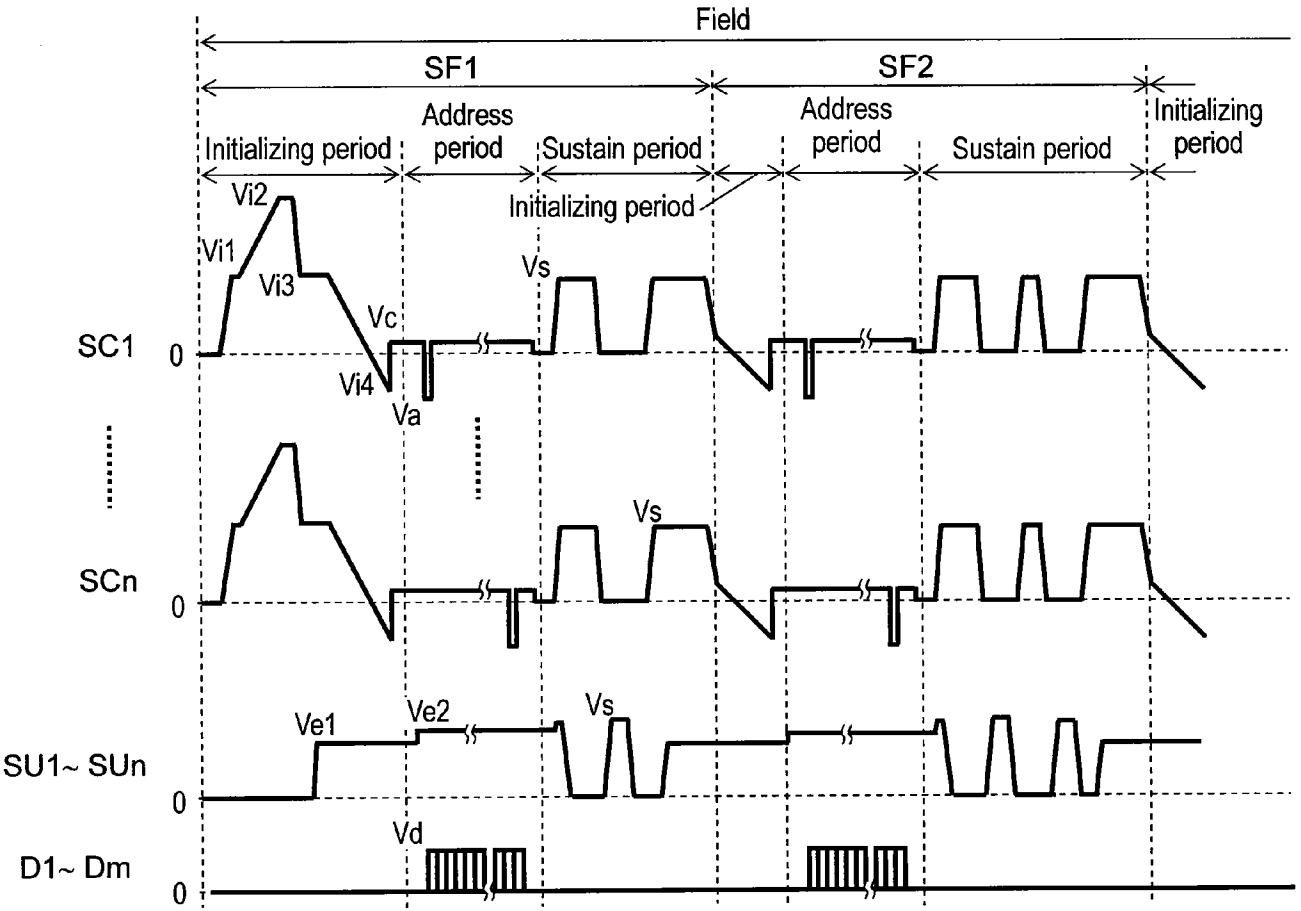
FIG. 4 is a diagram showing a driving voltage waveform of the plasma display device.

FIG. 4 is a diagram showing a driving voltage waveform of plasma display device 40 in accordance with the first exemplary embodiment of the present invention.

In the initializing period, firstly in the first half thereof, data electrodes D1 through Dm and sustain electrodes SU1 through SUn are kept at voltage 0 (V), and a ramp waveform voltage is applied to scan electrodes SC1 through SCn. Here, the ramp waveform voltage gradually rises from voltage Vi1, which is not higher than a discharge start voltage, to voltage Vi2, which is higher than the discharge start voltage. Then, feeble initializing discharge occurs in all discharge cells, and wall voltage is accumulated on scan electrodes SC1 through SCn, sustain electrodes SU1 through SUn, and data electrodes D1 through Dm. Here, the wall voltage on the electrodes means the voltage generated by wall charge accumulated on the dielectric layer for covering the electrodes and on the phosphor layers.

In the subsequent latter half of the initializing period, sustain electrodes SU1 through SUn are kept at positive voltage Ve1, and a ramp waveform voltage which gradually falls from voltage Vi3 to voltage Vi4 is applied to scan electrodes SC1 through SCn. At this time, feeble initializing discharge occurs again in all discharge cells, and the wall voltage on scan electrodes SC1 through SCn, sustain electrodes SU1 through SUn, and data electrodes D1 through Dm is adjusted to a value appropriate for address operation.

The first half of the initializing period may be omitted in some subfields of all subfields constituting one field. In that case, initializing operation is selectively performed in the discharge cell having undergone sustain discharge in the immediately preceding subfield. FIG. 4 shows a driving voltage waveform where initializing operation having a first half and latter half is performed in the initializing period of SF1 and initializing operation having only latter half is performed in the initializing period of SF2 and later.

In the address period, sustain electrodes SU1 through SUn are kept at voltage Ve2, and voltage Vc is applied to scan electrodes SC1 through SCn. Then, based on the image data of each color, an address pulse of voltage Vd is applied to data electrode Dk (k is 1 through m) of the discharge cell to emit light in the first row, of data electrodes D1 through Dm, and a scan pulse of voltage Va is applied to scan electrodes SC1 of the first row. At this time, address discharge occurs between data electrode Dk and scan electrode SC1 and between sustain electrode SU1 and scan electrode SC1, positive wall voltage is accumulated on scan electrode SC1 of this discharge cell, and negative wall voltage is accumulated on sustain electrode SU1. Thus, the address operation is performed where address discharge is caused in the discharge cell to emit light in the first row to accumulate wall voltage on each electrode. While, address discharge does not occur in the intersecting part of scan electrode SC1 and data electrode Dh ($h \neq k$) having undergone no address pulse. This address operation is sequentially performed until the discharge cell of the n-th row, and the address period is completed.

As discussed above, it is data electrode driving circuit 42 that drives each of data electrodes D1 through Dm. When the panel is seen from the side of data electrode driving circuit 42, each data electrode Dj serves as a capacitive load. Therefore, in the address period, whenever the voltage applied to each data electrode Dj is switched from voltage 0 (V) to voltage Vd, or from voltage Vd to voltage 0 (V), this capacitance must be charged and discharged. Increasing the frequency of charge and discharge increases the power consumption of data electrode driving circuit 42.

In the subsequent sustain period, the voltage of sustain electrodes SU1 through SUn is returned to voltage 0 (V), and a sustain pulse of voltage Vs is applied to scan electrodes SC1 through SCn. At this time, in the discharge cell having undergone the address discharge, the voltage between scan electrode SCi and sustain electrode SUi is obtained by adding the wall voltage on scan electrode SCi and that on sustain electrode SUi to voltage Vs, and exceeds the discharge start voltage. Then, sustain discharge occurs to emit light between scan electrode SCi and sustain electrode SUi. Negative wall voltage is accumulated on scan electrode SCi, and positive wall voltage is accumulated on sustain electrode SUi.

Subsequently, the voltage of scan electrodes SC1 through SCn is returned to 0 (V), and a sustain pulse of voltage Vs is applied to sustain electrodes SU1 through SUn. At this time, in the discharge cell having undergone the sustain discharge, the voltage between sustain electrode SUi and scan electrode SCi exceeds the discharge start voltage. Therefore, sustain discharge occurs again between sustain electrode SUi and scan electrode SCi, negative wall voltage is accumulated on sustain electrode SUi, and positive wall voltage is accumulated on scan electrode SCi. Hereinafter, similarly, as many sustain pulses as the number corresponding to the luminance weight are applied to scan electrodes SC1 through SCn and sustain electrodes SU1 through SUn, thereby continuously performing sustain discharge in the discharge cell where the address discharge occurs in the address period. In the discharge cell where the address discharge does not occur in the address period, the sustain discharge does not occur, and wall voltage at the completion of the initializing period is kept. Thus, the sustain operation in the sustain period is completed.

Also in subsequent SF2 through SF10, operation similar to that in SF1 is performed except for the number of sustain pulse.

In the subfield method, as discussed above, one field period is constituted by a plurality of subfields having a predetermined luminance weight. A plurality of combinations is selected from arbitrary combinations of the subfields, and a combination set for display is created. Using a combination of the subfields belonging to the combination set for display, the light emission or no light emission in a discharge cell is controlled and gradation is displayed. Hereinafter, the combination set for display created by selecting the plurality of combinations of the subfields is referred to as "coding table". In the present embodiment, a plurality of coding tables of different number of combinations is provided for the image signals of respective colors. These image signals are red image signal sigR (sometimes simply referred to as "sigR"), green image signal sigG (sometimes simply referred to as "sigG"), and blue image signal sigB (sometimes simply referred to as "sigB"). A used coding table is selected according to the signal level of the image signal of each color.

Next, the combination set for display used in the present embodiment, namely the coding table, is described. In order to simplify the description, the gradation when black is displayed is denoted with "0" and the gradation corresponding to luminance weight "N" is denoted with "N" for each of red image signal sigR, green image signal sigG, and blue image signal sigB. Therefore, the gradation of a discharge cell that undergoes light emission only in SF1 having luminance weight "1" is "1", and the gradation of a discharge cell that undergoes light emission both in SF1 having luminance weight "1" and in SF2 having luminance weight "2" is "3".

In the present embodiment, a coding table used for the image signal of each color is selected from two coding tables.

FIG. 5A, FIG. 5B, FIG. 5C, and FIG. 5D are diagrams showing coding tables used in plasma display device 40 of the first exemplary embodiment of the present invention. FIG. 5A, FIG. 5B, and FIG. 5C are diagrams showing the first coding table having 90 combinations of the subfields. FIG. 5D is a diagram showing the second coding table having 11 combinations of the subfields. In the present embodiment, each coding table used for the image signal of each color is selected from the two coding tables based on the signal level of the image signal of each color.

In FIG. 5A, FIG. 5B, FIG. 5C, and FIG. 5D, the numerical values in the leftmost column show gradations for display used for display. The right side thereof shows whether to emit light in a discharge cell in each subfield when each gradation is displayed, and "0" shows no light emission and "1" shows light emission. For example, in FIG. 5A, light is emitted in the discharge cell only in SF2 in order to display gradation "2", and light is emitted in the discharge cell in SF1, SF2, and SF5 in order to display gradation "14". In order to display gradation "3", there are a method of emitting light in the discharge cell in SF1 and SF2 and a method of emitting light only in SF3. When a plurality of combinations is thus allowed, the combination where light is emitted in subfields of minimum luminance weights is selected. In other words, when gradation "3" is displayed, light is emitted in the discharge cell in SF1 and SF2.

Image signal processing circuit 41 converts the image signal of each color (red image signal sigR, green image signal sigG, or blue image signal sigB) into image data of each color (red image data dataR, green image data dataG, or blue image data dataB). In the image data of each color, the light emission and no light emission in the discharge cell in each subfield correspond to bits "1" and "0" of the digital signal. Therefore, image data "0000000000" showing gradation "0" indicates no light emission in SF1 through SF10, image data "1000000000" showing gradation "1" indicates light emission only in SF1, image data "0100000000" showing gradation "2" indicates light emission only in SF2, and image data "1100000000" showing gradation "3" indicates light emission in SF1 and SF2.

The number of bit different from each other when corresponding bits between two pieces of image data are compared with each other is called hamming distance. For example, the hamming distance between the image data of gradation "0" and the image data of gradation "1" is "1" because corresponding bits in SF1 are not equal to each other. The hamming distance between the image data of gradation "0" and the image data of gradation "3" is "2" because corresponding bits in SF1 and SF2 are not equal to each other. The right columns of FIG. 5A, FIG. 5B, FIG. 5C, and FIG. 5D show the hamming distances between certain gradations for display and the next smaller gradations for display. Here, the next smaller gradation for display is the highest within the range smaller than the certain gradation for display. For example, the right column of gradation for display "247" shows hamming distance "3" between gradation for display "247" and the next smaller gradation for display "245".

In the first coding table, the hamming distances between adjacent gradations for display are large, their values are "1", "2", or "3", and the average value of them is "1.91". In the second coding table, the hamming distances are the smallest, their values are "1", and the average value of them is also "1.00". In the first coding table and second coding table of the present embodiment, thus, the average value of the hamming distances between certain gradations and the next smaller gradations in the coding table having a small number of combinations is smaller than that in the coding table having a large number of combinations.

When the coding table having the large number of combinations of the subfields is used for displaying an image, the number of displayable gradation increases and hence the representing performance of the image can be improved. When the hamming distances increase, however, switching frequency of the voltage applied to each data electrode Dj from voltage 0 (V) to voltage Vd or from voltage Vd to voltage 0 (V) increases in the address period, and the power consumption of data electrode driving circuit 42 increases.

Therefore, when the coding table having the large number of combinations of the subfields is used, the number of displayable gradation increases and hence the representing performance of the image improves, but the hamming distances between adjacent gradations for display increase to increase the power consumption. When the coding table having the small number of combinations of the subfields is used, the number of displayable gradation decreases and hence the representing performance of the image degrades. However, in the latter case, the hamming distances between adjacent gradations for display decrease to suppress the power consumption.

Therefore, an image signal where the image display quality does not reduce even if the number of displayable gradation is small is determined based on a predetermined determination reference, and the coding table having the small number of combinations of the subfields for the image signal is selected, thereby suppressing the power consumption of data electrode driving circuit 42. In the present embodiment, the signal levels of image signals of respective colors are compared with each other, and the coding table having the large number of displayable gradations is used for the image signal of the color having a relatively large signal level, thereby securing the image display quality. For the image signal of the color that has a relatively low signal level, the image display quality does not significantly reduce even if the number of displayable gradation is small, and hence the coding table having the small number of combinations of the subfields is used to suppress the power consumption. Thus, respective signal levels of red image signal sigR, green image signal sigG, and blue image signal sigB are compared with each other. For the image signal of a color that has a relatively low signal level, the following combination set for display is used. In this combination set, the number of combination is smaller than that in the combination set for display used for the image signal of a color that has a relatively high signal level. Thus, the electric power is reduced without sacrificing the image display quality.

Specifically, the predetermined selection reference for red image signal sigR is the ratio of the signal level of red image signal sigR to the signal level of green image signal sigG. Therefore, for red image signal sigR where the ratio of the signal level to that of green image signal sigG is smaller than predetermined constant Kr, the following combination set for display is used. In this combination set, the number of combination is smaller than that in the combination set for display used for red image signal sigR where the ratio of the signal level to that of green image signal sigG is predetermined constant Kr or larger.

In other words, red image signal sigR is compared with green image signal sigG. The first coding table is used for red image signal sigR in a region satisfying $$\mathrm{sig}R \geqq \mathrm{sig}G \times Kr. \quad \text{(condition R1)}$$

The second coding table is used for red image signal sigR in a region satisfying $$\mathrm{sig}R < \mathrm{sig}G \times Kr. \quad \text{(condition R2)}$$

Here, constant Kr is set for red image signal sigR, and is one selected in a random fashion from "0.8", "0.75", "0.7", and "0.65" for each pixel. Disturbance is thus added to the selection reference.

The predetermined selection reference for green image signal sigG is the ratio of the signal level of green image signal sigG to the higher one of the signal levels of red image signal sigR and blue image signal sigB. For green image signal sigG where the ratio of the signal level to the higher one of the signal levels of red image signal sigR and blue image signal sigB is smaller than predetermined constant Kg, the following combination set for display is used. In this combination set, the number of combination is smaller than that in the combination set for display used for green image signal sigG where the ratio of the signal level to the higher one of the signal levels of red image signal sigR and blue image signal sigB is predetermined constant Kg or larger.

In other words, red image signal sigR, green image signal sigG, and blue image signal sigB are compared with each other. The first coding table is used for green image signal sigG in a region satisfying $$\mathrm{sig}G \geqq \max(\mathrm{sig}R, \mathrm{sig}B) \times Kg. \quad \text{(condition G1)}$$

Here, max(A, B) means selection of the higher one of numerical values A and B.

The second coding table is used for green image signal sigG in a region satisfying $$\mathrm{sig}G < \max(\mathrm{sig}R, \mathrm{sig}B) \times Kg. \quad \text{(condition G2)}$$

Here, constant Kg is set for green image signal sigG, and is one selected in a random fashion from "0.3", "0.25", "0.2", and "0.15" for each pixel. Disturbance is thus added to the selection reference.

The predetermined selection reference for blue image signal sigB is the ratio of the signal level of blue image signal sigB to the signal level of green image signal sigG. Therefore, for blue image signal sigB where the ratio of the signal level to that of green image signal sigG is smaller than predetermined constant Kb, the following combination set for display is used. In this combination set, the number of combination is smaller than that in the combination set for display used for blue image signal sigB where the ratio of the signal level to that of green image signal sigG is predetermined constant Kb or larger.

In other words, blue image signal sigB is compared with green image signal sigG. The first coding table is used for blue image signal sigB in a region satisfying $$\mathrm{sig}B \geqq \mathrm{sig}G \times Kb. \quad \text{(condition B1)}$$

The second coding table is used for blue image signal sigB in a region satisfying $$\mathrm{sig}B < \mathrm{sig}G \times Kb. \quad \text{(condition B2)}$$

Here, constant Kb is set for blue image signal sigB, and is one selected in a random fashion from "0.8", "0.75", "0.7", and "0.65" for each pixel. Disturbance is thus added to the selection reference.

When the signal levels of the image signals of respective colors are equal to each other, the green light emission has the highest luminance comparing with the red light emission and blue light emission, the visual sensitivity to the gradation is also the highest. In the present embodiment, in consideration of the above-mentioned discussion, a coding table used for red image signal sigR is selected by comparing red image signal sigR with green image signal sigG, and a coding table used for blue image signal sigB is selected by comparing blue image signal sigB with green image signal sigG.

Figure 6:
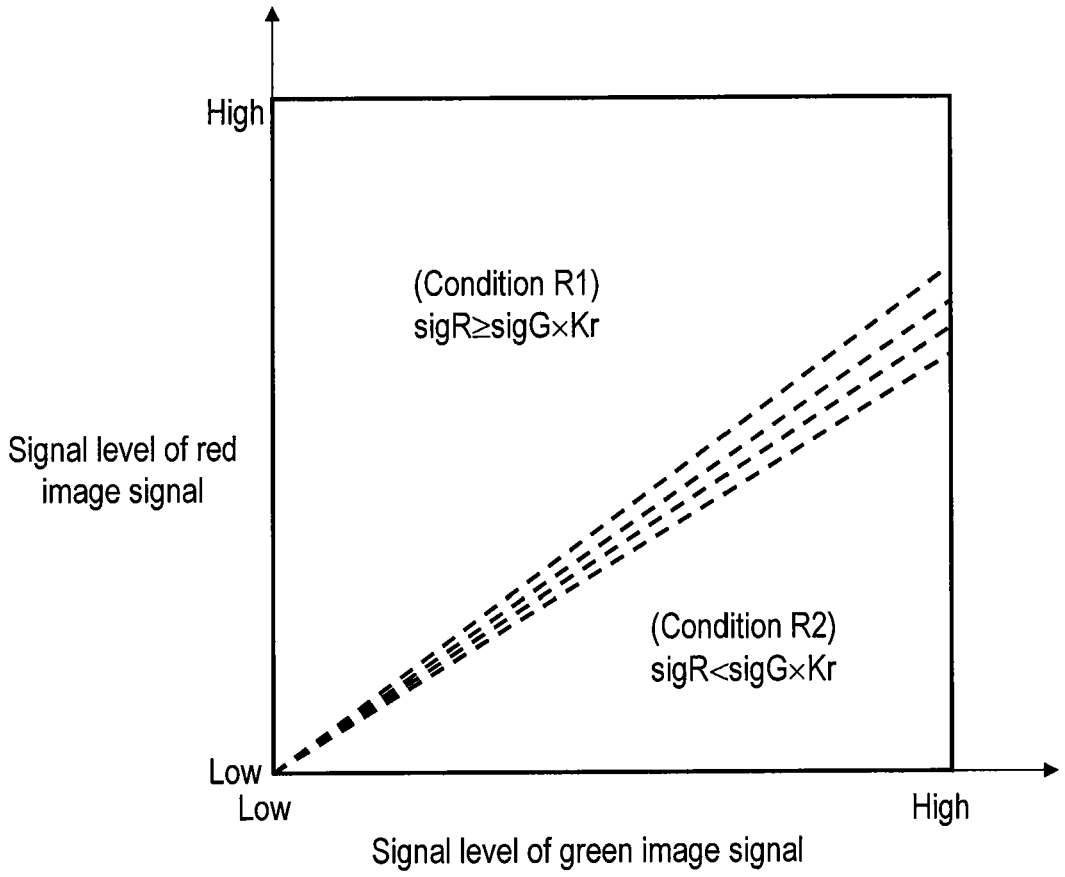
FIG. 6 is a schematic diagram showing the selective use of the coding tables of the plasma display device.

FIG. 6 is a schematic diagram showing the selective use of the coding tables of plasma display device 40 in accordance with the first exemplary embodiment of the present invention. The vertical axis shows the signal level of red image signal sigR, and the horizontal axis shows the signal level of green image signal sigG. To make the diagram easy-to-understand, the signal level of blue image signal sigB is assumed to be "0".

Regarding an image signal satisfying (condition R1) in FIG. 6, the signal level of red image signal sigR is higher than that of green image signal sigG, and hence the first coding table is used for red image signal sigR. Regarding an image signal satisfying (condition R2), the signal level of red image signal sigR is lower than that of green image signal sigG, and hence the second coding table is used for red image signal sigR. Four broken lines for separating (condition R1) and (condition R2) from each other correspond to four values "0.8", "0.75", "0.7", and "0.65" of constant Kr.

In the present embodiment, the second coding table is thus used for a signal where relative signal level is low and the display quality of the image does not reduce even when the number of displayable gradation decreases, among the image signals of respective colors. Thus, the electric power is reduced without sacrificing the image display quality.

Constants Kr, Kg, and Kb for determining the signal levels of the image signals are varied and set probabilistically for each pixel. Therefore, the switching boundary between used coding tables is diffused in a random fashion.

Figure 7:
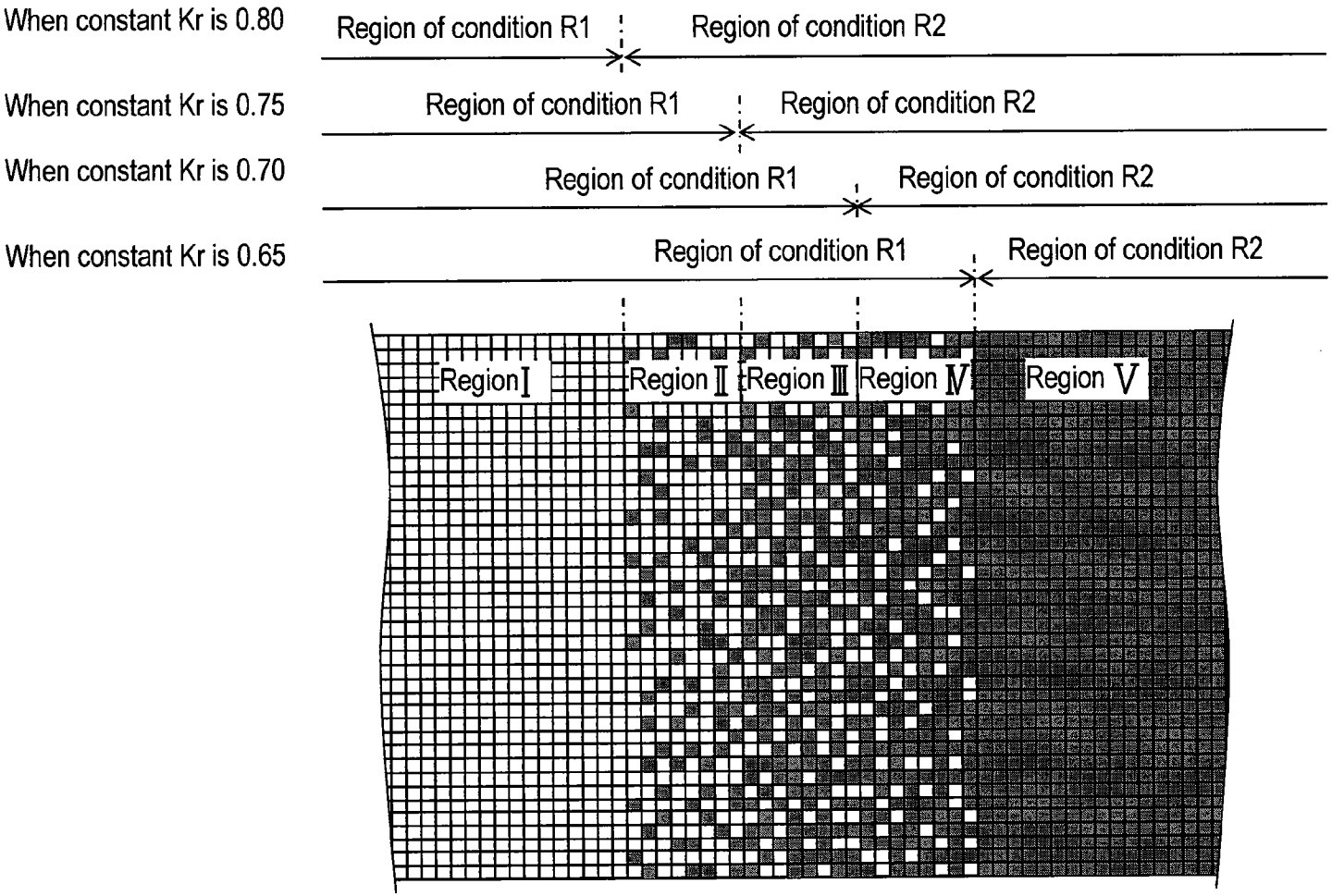
FIG. 7 is a schematic diagram showing a switching state between the coding tables of the plasma display device.

FIG. 7 is a schematic diagram showing a switching state between the coding tables for red image signal sigR in plasma display device 40 in accordance with the first exemplary embodiment of the present invention. FIG. 7 shows regions using the first coding table, regions using the second coding table, and boundaries between them. Specifically, FIG. 7 shows an image of the following state: the signal levels of green image signals sigG are constant, and the signal levels of red image signals sigR are large on the left side and decrease toward the right side, for example. The first coding table is used for the pixels shown with bright color, and the second coding table is used for the pixels shown with dark color.

In FIG. 7, the first coding table is used for the pixels satisfying (condition R1), and the second coding table is used for the pixels satisfying (condition R2). When the value of constant Kr is large, the value derived by multiplying green image signals sigG by constant Kr also increases, and hence the region satisfying (condition R1) becomes small and the region satisfying (condition R2) becomes large. When the value of constant Kr is small, the region satisfying (condition R1) becomes large and the region satisfying (condition R2) becomes small.

In the present embodiment, constant Kr is selected for each pixel in a random fashion from "0.8", "0.75", "0.7", and "0.65". For the pixels in region I, (condition R1) is determined to be satisfied whichever the value of constant Kr is, and light emission or no light emission is controlled using the first coding table. For the pixels in region II, (condition R2) is determined to be satisfied when the value of constant Kr is "0.8", and (condition R1) is determined to be satisfied when the value of constant Kr is "0.75", "0.7", or "0.65". For the pixels in region II, therefore, the first coding table is used in a probability of ¾, and the second coding table is used in a probability of ¼. For the pixels in region III, (condition R2) is determined to be satisfied when the value of constant Kr is "0.8" or "0.75", and (condition R1) is determined to be satisfied when the value of constant Kr is "0.7" or "0.65". For the pixels in region III, therefore, the first coding table is used in a probability of ½, and the second coding table is used in a probability of ½. For the pixels in region IV, (condition R2) is determined to be satisfied when the value of constant Kr is "0.8", "0.75", or "0.7", and (condition R1) is determined to be satisfied when the value of constant Kr is "0.65". For the pixels in region IV, therefore, the first coding table is used in a probability of ¼, and the second coding table is used in a probability of ¾. For the pixels in region V, (condition R2) is determined to be satisfied whichever the value of constant Kr is, and the second coding table is used.

In the present embodiment, constant Kr is set by selecting one from four numerical values, so that three transition regions II, III, and IV can be disposed between region I using the first coding table and region V using the second coding table.

Constant Kg for green image signal sigG, and constant Kb for blue image signal sigB are similar to constant Kr. The transition regions where discharge cells for controlling light emission or no light emission using each coding table are probabilistically distributed are disposed in the switching boundary between the coding tables, and thus coding tables are switched smoothly.

Next, the configuration of image signal processing circuit 41 is described.

Figure 8:
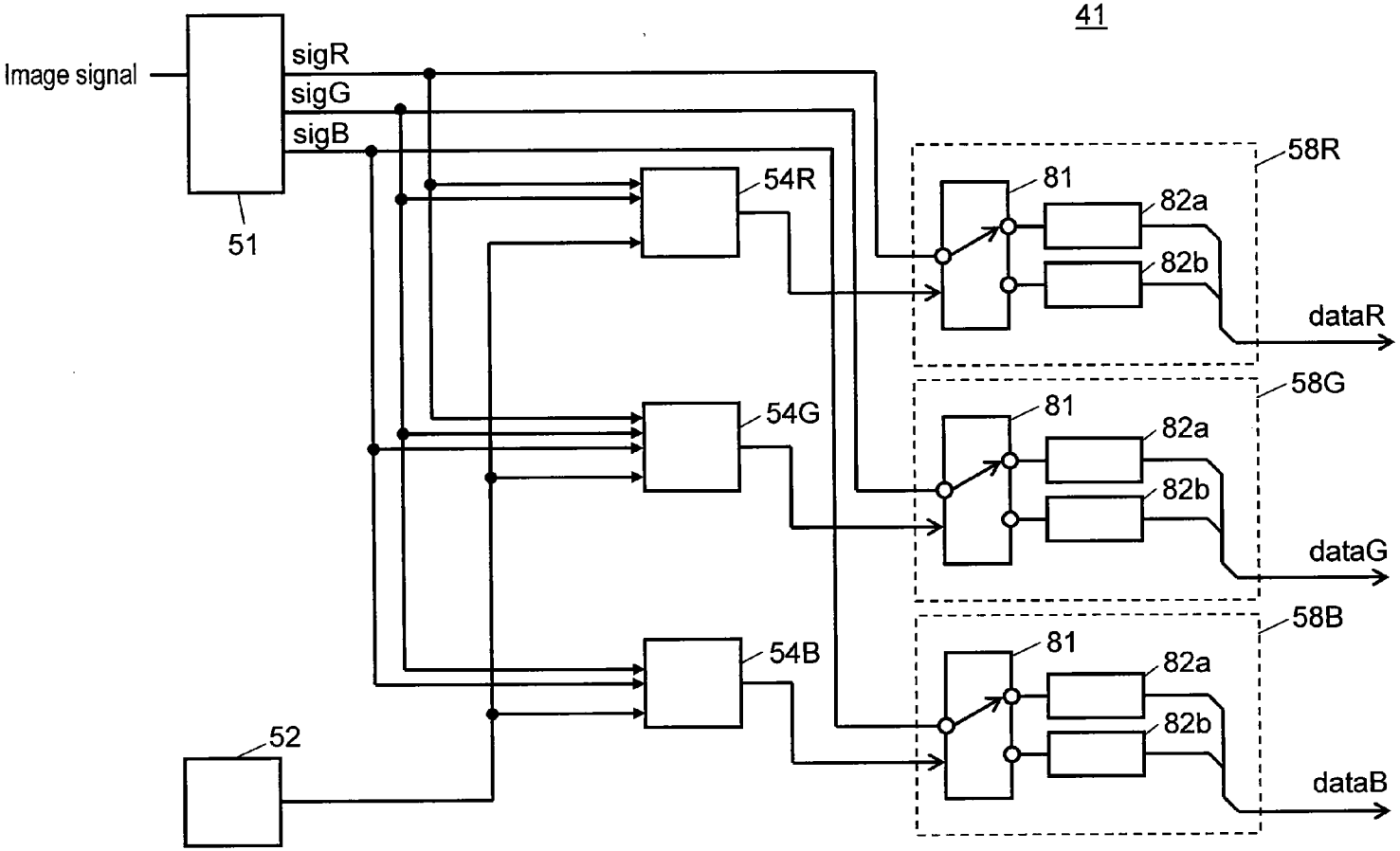
FIG. 8 is a circuit block diagram showing the detail of an image signal processing circuit of the plasma display device.

FIG. 8 is a circuit block diagram showing the detail of image signal processing circuit 41 of plasma display device 40 in accordance with the first exemplary embodiment of the present invention. Image signal processing circuit 41 has color separating section 51, random number generating section 52, R comparing section 54R, G comparing section 54G, B comparing section 54B, R data converting section 58R, G data converting section 58G, and B data converting section 58B.

Color separating section 51 separates an input image signal such as a National Television Standards Committee (NTSC) image signal into three primary colors, namely red image signal sigR, green image signal sigG, and blue image signal sigB. When image signals of respective colors are input as input image signals, color separating section 51 may be omitted.

Random number generating section 52 generates a random number for each pixel. The generated random numbers are random numbers of a binary of 2 bits, and are one of "00", "01", "10", or "11".

Figure 9:
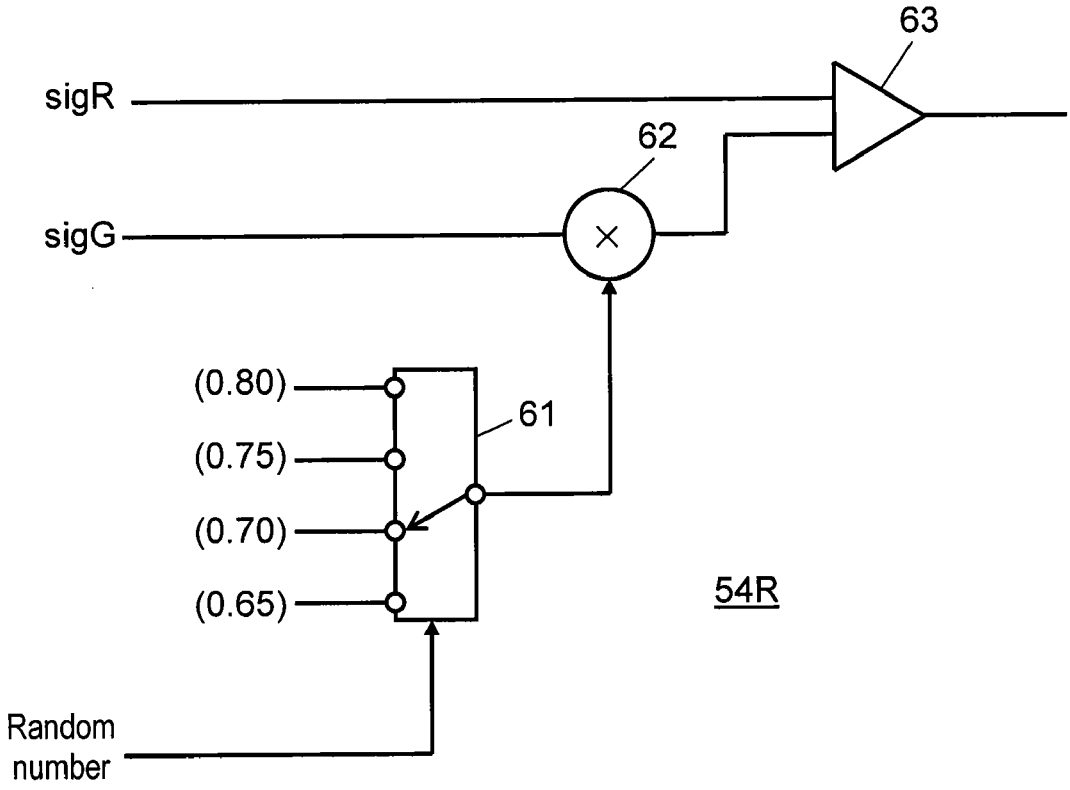
FIG. 9 is a circuit block diagram of an R comparing section in the plasma display device.

R comparing section 54R sets constant Kr based on the random number generated by random number generating section 52, and compares constant Kr times green image signal sigG with red image signal sigR. FIG. 9 is a circuit block diagram of R comparing section 54R in plasma display device 40 in accordance with the first exemplary embodiment of the present invention. R comparing section 54R has selector 61, multiplier 62, and comparator 63. Selector 61 selects one from candidate numerical values "0.8", "0.75", "0.7", and "0.65" for constant Kr based on the random number generated by random number generating section 52. Multiplier 62 multiplies green image signal sigG by constant Kr selected by selector 61. Comparator 63 compares red image signal sigR with an output of multiplier 62. R comparing section 54R thus outputs a signal indicating which of (condition R1) and (condition R2) is satisfied as the comparison result to R data converting section 58R.

G comparing section 54G and B comparing section 54B operate similarly to R comparing section 54R.

R data converting section 58R has coding selecting section 81 and two coding tables 82*a* and 82*b*, and converts red image signal sigR into red image data dataR. Here, red image data dataR is a combination of subfields for controlling the light emission or no light emission of a red discharge cell.

Coding selecting section 81 selects one of two coding tables 82*a* and 82*b* based on the comparison result of R comparing section 54R. Specifically, coding selecting section 81 selects first coding table 82*a* in a region satisfying (condition R1), and selects second coding table 82*b* in a region satisfying (condition R2). Each of coding tables 82*a* and 82*b* is constituted by a data converting table in a read only memory (ROM) or the like, and converts input red image signal sigR into red image data dataR.

G data converting section 58G and B data converting section 58B have a configuration similar to that of R data converting section 58R.

Here, coding table 82*a* is the first coding table shown in FIG. 5A, FIG. 5B, and FIG. 5C. Coding table 82*b* is the second coding table shown in FIG. 5D.

Thanks to such a configuration, a combination set for display selected from a plurality of combination sets for display based on the predetermined selection reference is used for each of red image signal sigR, green image signal sigG, and blue image signal sigB, and disturbance based on a random number can be added to the predetermined selection reference. This operation can reduce electric power without sacrificing the image display quality.

In the present embodiment, as each coding table used for the image signal of each color, one coding table is selected and used from two coding tables based on the relative comparison between signal levels of the image signals of respective colors, for example. However, the present invention is not limited to this. For example, three or more coding tables may be disposed for the image signal of each color, and one coding table may be selected and used from three or more coding tables based on the signal level of the image signal of each color. The coding tables may be selectively used in consideration of not only the signal level of the image signal of each color but also another attribute such as motion of the image. A circuit for displaying gradation that is not included in the gradations for display may be added. One example thereof is hereinafter described as a second exemplary embodiment.

(Second Exemplary Embodiment)

The structure of the panel and the driving voltage waveforms applied to the electrodes are the same as those of the first exemplary embodiment, so that descriptions of them are omitted. In the second exemplary embodiment, each coding table used for the image signal of each color is selected and used from four coding tables. Each coding table used for an image signal of each color is selected based on the relative signal level of the image signal of each color, the absolute signal level of the image signal, the spatial difference of the image signal of each color, and the time difference of the image signal of each color.

FIG. 10A, FIG. 10B, FIG. 10C, FIG. 10D, FIG. 10E, and FIG. 10F are diagrams showing coding tables used in plasma display device 40 in accordance with the second exemplary embodiment of the present invention. FIG. 10A and FIG. 10B show a first coding table having 90 combinations of subfields, and this coding table is the same as the first coding table shown in FIG. 5A, FIG. 5B, and FIG. 5C. FIG. 10C and FIG. 10D show a second coding table having 44 combinations of subfields, and FIG. 10E shows a third coding table having 20 combinations of subfields. FIG. 10F shows a fourth coding table having 11 combinations of subfields, and this coding table is the same as the second coding table shown in FIG. 5D.

In the first coding table, the hamming distances between adjacent gradations for display are the largest, their values are "1", "2", or "3", and the average value of them is "1.91". In the second coding table, the hamming distances are "1" or "2", "2" appears more frequently, and the average value of them is "1.77". In the third coding table, the hamming distances are "1" or "2", the appearing frequency of "2" is substantially the same as that of "1", and the average value of them is "1.47". In the fourth coding table, the hamming distances are the smallest, their values are "1", and the average value of them is also "1.00". Also in the present embodiment, the average value of the hamming distances between certain gradations and the next smaller gradations in the coding table that has a small number of combinations is set to be smaller than that in the coding table that has a large number of combinations.

As discussed above, when a coding table having a large number of combinations of the subfields is used, the number of displayable gradation increases and hence the representing performance of the image improves. However, the hamming distances between adjacent gradations for display increase to increase the power consumption. In addition, a false contour is apt to occur. When the coding table having a small number of combinations of the subfields is used, the number of displayable gradation decreases and hence the representing performance of the image degrades. However, in the latter case, the hamming distances between adjacent gradations for display decrease to suppress the power consumption. In addition, a false contour hardly occurs.

Therefore, regarding an image signal whose image display quality does not reduce even when the number of displayable gradation is small, using a coding table having a small number of combinations of the subfields for this image signal can suppress the power consumption of data electrode driving circuit 42. In the present embodiment, each coding table used for the image signal of each color is determined based on the degree of the visual sensitivity to the gradation. The degree of the visual sensitivity to the gradation can be determined based on the absolute signal level of the image signal of each color, the relative signal level of the image signal of each color, the level of spatial difference of the image signal, and the level of time difference of the image signal.

In the second exemplary embodiment, similarly to the first exemplary embodiment, the switching boundary between used coding tables is diffused in a random fashion, thereby switching the coding tables without reducing the image display quality. The absolute signal level of the image signal of each color, the relative signal level, the degree of the spatial difference of the image signal, and the degree of time difference of the image signal are hereinafter, sequentially described.

The absolute signal level of the image signal is firstly described. An image where the absolute value of luminance is low has a high visual sensitivity to the gradation, so that it is preferable to use a coding table having many combinations of the subfields. The predetermined selection reference related to the absolute signal level of an image signal is luminance of the image signal, and dark image or bright image is determined as follows.

Each of red image signal sigR, green image signal sigG, and blue image signal sigB is multiplied by a coefficient proportional to the luminance, thereby determining luminance conversion signal sigY using $$\mathrm{sig}Y=0.2\times\mathrm{sig}R+0.7\times\mathrm{sig}G+0.1\times\mathrm{sig}B.$$

Luminance conversion signal sigY is compared with constant BRT, and dark image is determined when the following condition is satisfied:

$$\mathrm{sigY}<\mathrm{BRT}.$$

Bright image is determined when the following condition is satisfied:

$$\mathrm{sigY}\geqq\mathrm{BRT}.$$

Here, constant BRT is set by selecting one from "20", "18", "16", and "14" for each pixel in a random fashion. Disturbance is thus added to the selection reference.

Next, the relative signal level of the image signal of each color is described. The predetermined selection reference related to the relative signal level of the image signal is a relative signal level to an image signal of another color, and high signal level, intermediate signal level, or low signal level is determined as follows.

Attention is firstly focused on red image signal sigR. Red image signal sigR is compared with green image signal sigG. High signal level is determined when the following condition is satisfied:

$$\mathrm{sig}G\times Kr1\leqq\mathrm{sig}R.$$

Intermediate signal level is determined when the following condition is satisfied:

$$\mathrm{sig}G\times Kr2\leqq\mathrm{sig}R<\mathrm{sig}G\times Kr1.$$

Low signal level is determined when the following condition is satisfied:

$$\mathrm{sig}R<\mathrm{sig}G\times Kr2.$$

Here, constants Kr1 and Kr2 are set for red image signal sigR. Kr1 is set by selecting one from "1.6", "1.5", "1.4", and "1.3" for each pixel in a random fashion, and Kr2 is set by selecting one from "0.8", "0.75", "0.7", and "0.65" for each pixel in a random fashion. Disturbance is thus added to the selection reference.

Attention is then focused on green image signal sigG. Red image signal sigR, green image signal sigG, and blue image signal sigB are compared with each other. High signal level is determined when the following condition is satisfied:

$$\max(\mathrm{sig}R,\mathrm{sig}B)\times Kg1\leqq \mathrm{sig}G.$$

Intermediate signal level is determined when the following condition is satisfied:

$$\max(\mathrm{sig}R,\mathrm{sig}B)\times Kg2\leqq \mathrm{sig}G<\max(\mathrm{sig}R,\mathrm{sig}B)\times Kg1.$$

Low signal level is determined when the following condition is satisfied:

$$\mathrm{sig}G<\max(\mathrm{sig}R,\mathrm{sig}B)\times Kg2.$$

Here, constants Kg1 and Kg2 are set for green image signal sigG. Kg1 is set by selecting one from "0.55", "0.5", "0.45", and "0.4" for each pixel in a random fashion, and Kg2 is set by selecting one from "0.3", "0.25", "0.2", and "0.15" for each pixel in a random fashion. Disturbance is thus added to the selection reference.

Attention is then focused on blue image signal sigB. Blue image signal sigB is compared with green image signal sigG. High signal level is determined when the following condition is satisfied:

$$\mathrm{sig}G\times Kb1\leqq \mathrm{sig}B.$$

Intermediate signal level is determined when the following condition is satisfied:

$$\mathrm{sig}G\times Kb2\leqq \mathrm{sig}B<\mathrm{sig}G\times Kb1.$$

Low signal level is determined when the following condition is satisfied:

$$\mathrm{sig}B<\mathrm{sig}G\times Kb2.$$

Here, constants Kb1 and Kb2 are set for blue image signal sigB. Kb1 is set by selecting one from "1.6", "1.5", "1.4", and "1.3" for each pixel in a random fashion, and Kb2 is set by selecting one from "0.8", "0.75", "0.7", and "0.65" for each pixel in a random fashion. Disturbance is thus added to the selection reference.

Figure 11A:
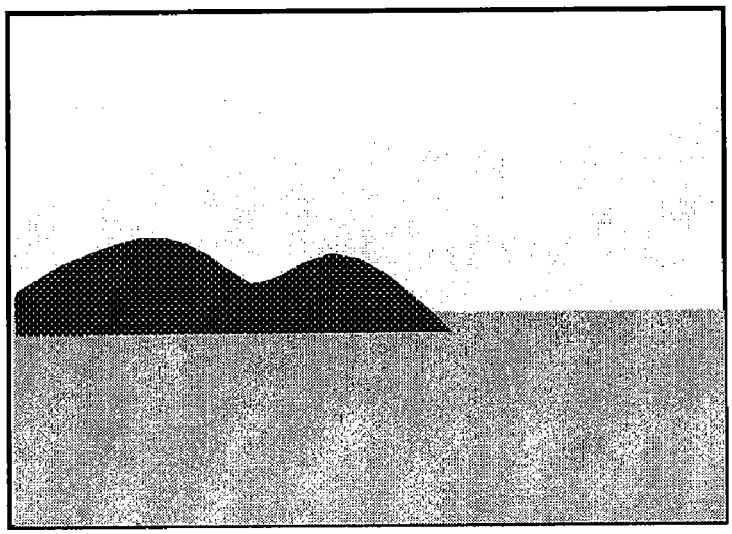
FIG. 11A is a diagram showing an example of a display image of the plasma display device.
Figure 11B:
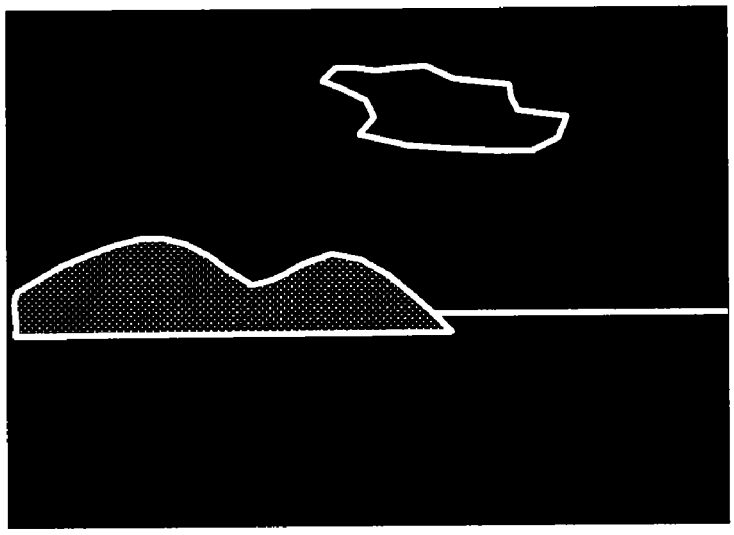
FIG. 11B is a diagram showing a differential signal of an example of a display image of the plasma display device.

Next, the degree of the spatial difference of the image signal of each color is described. In a region where variation in gradation is large in a display image, the image display quality hardly reduces even when the number of displayable gradation is small. Therefore, the spatial difference of the image signal is calculated, and a coding table having a small number of combinations of the subfields can be used for an image signal of large spatial difference. FIG. 11A and FIG. 11B are diagrams showing an example of a display image of plasma display device 40 and the differential signals of this image in accordance with the second exemplary embodiment of the present invention. FIG. 11A shows the example of the display image, and FIG. 11B shows the differential image. In the region where white is displayed in FIG. 11B, the signal levels of the differential signals are large, a coding table having a small number of combinations of the subfields can be used. In the region where black is displayed, the signal levels of the differential signals are low, and a coding table having a large number of combinations of the subfields is preferably used for an image signal in this region in order to prevent the reduction of the image display quality.

In this case, the predetermined selection reference for the image signal of each color, of red image signal sigR, green image signal sigG, and blue image signal sigB, is the ratio of the absolute value of the spatial difference for the image signal of the color to the signal level of the image signal of the color.

Specifically, the spatial difference of the image signal is firstly calculated. In a calculating method of the spatial difference, for red image signal sigR(x, y) at position (x, y) of a pixel on a display screen for example, the following red differential signal may be calculated as the spatial difference:

$$\mathrm{dif}R(x,y)=[\{\mathrm{sig}R(x-1,y)-\mathrm{sig}R(x+1,y)\}^2+\{\mathrm{sig}R(x,y-1)-\mathrm{sig}R(x,y+1)\}^2]^{1/2}.$$

Similarly to this, green differential signal difG and blue differential signal difB are calculated.

In the present embodiment, however, attention is focused on only spatial difference of the vertical direction, the following red differential signal is calculated as the spatial difference:

$$\mathrm{dif}R(x,y)=|\mathrm{sig}R(x,y-1)-\mathrm{sig}R(x,y)|.$$

In this calculating method, the differential component of the horizontal direction is not reflected, but the calculation can be greatly simplified. Similarly to this, green differential signal difG(x, y) and blue differential signal difB(x, y) are calculated.

Next, small spatial difference or large spatial difference is determined based on the calculated red differential signal difR, green differential signal difG, and blue differential signal difB, as follows.

Attention is firstly focused on red image signal sigR. Small spatial difference is determined when the following condition is satisfied:

$$\mathrm{dif}R(x,y)<\mathrm{sig}R(x,y)/Cr.$$

Large spatial difference is determined when the following condition is satisfied:

$$\mathrm{dif}R(x,y)\geqq \mathrm{sig}R(x,y)/Cg.$$

Here, constant Cr is set for red image signal sigR, and is one selected from "8.5", "8.0", "7.5", and "7.0" for each pixel in a random fashion. By adding disturbance to the selection reference, the coding tables are switched while the switching boundary between the used coding tables is diffused in a random fashion.

Attention is then focused on green image signal sigG. Small spatial difference is determined when the following condition is satisfied:

$$\mathrm{dif}G(x,y)<\mathrm{sig}G(x,y)/Cg.$$

Large spatial difference is determined when the following condition is satisfied:

$$\mathrm{dif}G(x,y)\geqq \mathrm{sig}G(x,y)/Cg.$$

Here, constant Cg is set for green image signal sigG, and is one selected from "8.5", "8.0", "7.5", and "7.0" for each pixel in a random fashion. Disturbance is thus added to the selection reference.

Attention is then focused on blue image signal sigB. Small spatial difference is determined when the following condition is satisfied:

$$\mathrm{dif}B(x,y)<\mathrm{sig}B(x,y)/Cb.$$

Large spatial difference is determined when the following condition is satisfied:

$$\mathrm{dif}B(x,y)\geqq \mathrm{sig}B(x,y)/Cb.$$

Here, constant Cb is set for blue image signal sigB, and is one selected from "8.5", "8.0", "7.5", and "7.0" for each pixel in a random fashion. Disturbance is thus added to the selection reference.

Next, the degree of the time difference of the image signal of each color is described. In a region where a still image or an image slow in motion (hereinafter, collectively referred to as "still image") is displayed, the visual sensitivity to the gradation is apt to be high. In a region where an image fast in motion (hereinafter referred to as "moving image") is displayed, the visual sensitivity to the gradation is apt to be low. Therefore, the time difference of the image signal is calculated. In a region where a moving image having large time difference is displayed, a coding table having a small number of combinations of the subfields can be used. In a region where a still image having small time difference is displayed, a coding table having a large number of combinations of the subfields is used preferably.

Regarding the motion of the image signal, the time difference of the image signal is calculated. The following method can be employed for calculating the time difference. For red image signal sigR(x, y, t) at position (x, y) of a pixel on a display screen and at time (t) for example, the absolute value of the difference between red image signal sigR(x, y, t) and red image signal sigR(x, y, t−1) of the preceding frame is calculated, and the time difference can be calculated using $$\mathrm{mov}R(x,y,t)=|\mathrm{sig}R(x,y,t-1)-\mathrm{sig}R(x,y,t)|.$$

Green differential signal movG(x, y, t) and blue differential signal movB(x, y, are calculated similarly.

Next, still image or moving image is determined as follows based on calculated red differential signal movR, green differential signal movG, and blue differential signal movB.

Moving image is determined when one of the following conditions is satisfied:

$\mathrm{mov}R(x,y,t)\geqq\mathrm{sig}R(x,y,t)/Mr$, for red image signal sigR;

$\mathrm{mov}G(x,y,t)\geqq\mathrm{sig}G(x,y,t)/Mg$, for green image signal sigG; and $\mathrm{mov}B(x,y,t)\geqq\mathrm{sig}B(x,y,t)/Mb$, for blue image signal sigB.

Still image is determined when none of them is satisfied.

Here, constants Mr, Mg, and Mb are predetermined constants, and Mr=Mg=Mb=4 in the present embodiment.

FIG. 12 is a diagram showing the selective use of the coding tables for the image signal of plasma display device 40 in accordance with the second exemplary embodiment of the present invention. Regarding an image signal where luminance conversion signal sigY is low and dark image is determined, the first coding table is used for each of red image signal sigR, green image signal sigG, and blue image signal sigB. Regarding an image signal where luminance conversion signal sigY is high and bright image is determined, the coding tables are used as follows.

Regarding a still image where the relative signal level of the image signal is high and the spatial difference is small, the first coding table is used for each of red image signal sigR, green image signal sigG, and blue image signal sigB. Regarding a moving image where the relative signal level of the image signal is high and the spatial difference is small, the second coding table is used for each of red image signal sigR, green image signal sigG, and blue image signal sigB. The fourth coding table is used for red image signal sigR and blue image signal sigB where the relative signal level is high and the spatial difference is also large, and the third coding table is used for green image signal sigG. The third coding table is used for red image signal sigR, green image signal sigG, and blue image signal sigB where the relative signal level of the image signal is intermediate and the spatial difference is small. The fourth coding table is used for red image signal sigR and blue image signal sigB where the relative signal level of the image signal is intermediate and the spatial difference is large, and the third coding table is used for green image signal sigG. The fourth coding table is used for red image signal sigR, green image signal sigG, and blue image signal sigB where the relative signal level is low.

In a region where the relative signal level of the image signal is low, the light emission or no light emission of a discharge cell is controlled using a coding table where the number of combination is smaller than that in a coding table used in a region where the relative signal level is high. In a region in the display image where the variation in gradation is large, the light emission or no light emission of a discharge cell is controlled using a coding table where the number of combination is smaller than that in a coding table used in a region where the variation in gradation is small. In a region for displaying a moving image, the light emission or no light emission of a discharge cell is controlled using a coding table where the number of combination is smaller than that in a coding table used in a region for displaying a still image.

In the present embodiment, constants Kr1, Kr2, Kg1, Kg2, Kb1, and Kb2 for determining the height of the signal level of an image signal, and constants Cr, Cg, and Cb for determining the degree of the spatial difference of the image signal are set while being probabilistically varied for each pixel. These constants are set while being switched for each pixel in a random fashion, so that the switching boundary between the used coding tables is diffused in a random fashion. Thus, a transition region where discharge cells for controlling the light emission or no light emission using each coding table are distributed probabilistically is disposed in the switching boundary between the coding tables, thereby suppressing occurrence of a contour of the boundary part.

In the present embodiment, constants Mr, Mg, and Mb for determining still image or moving image have been described to have predetermined values. However, the present invention is not limited to this. These constants Mr, Mg, and Mb may be set while being probabilistically varied.

Figure 13:
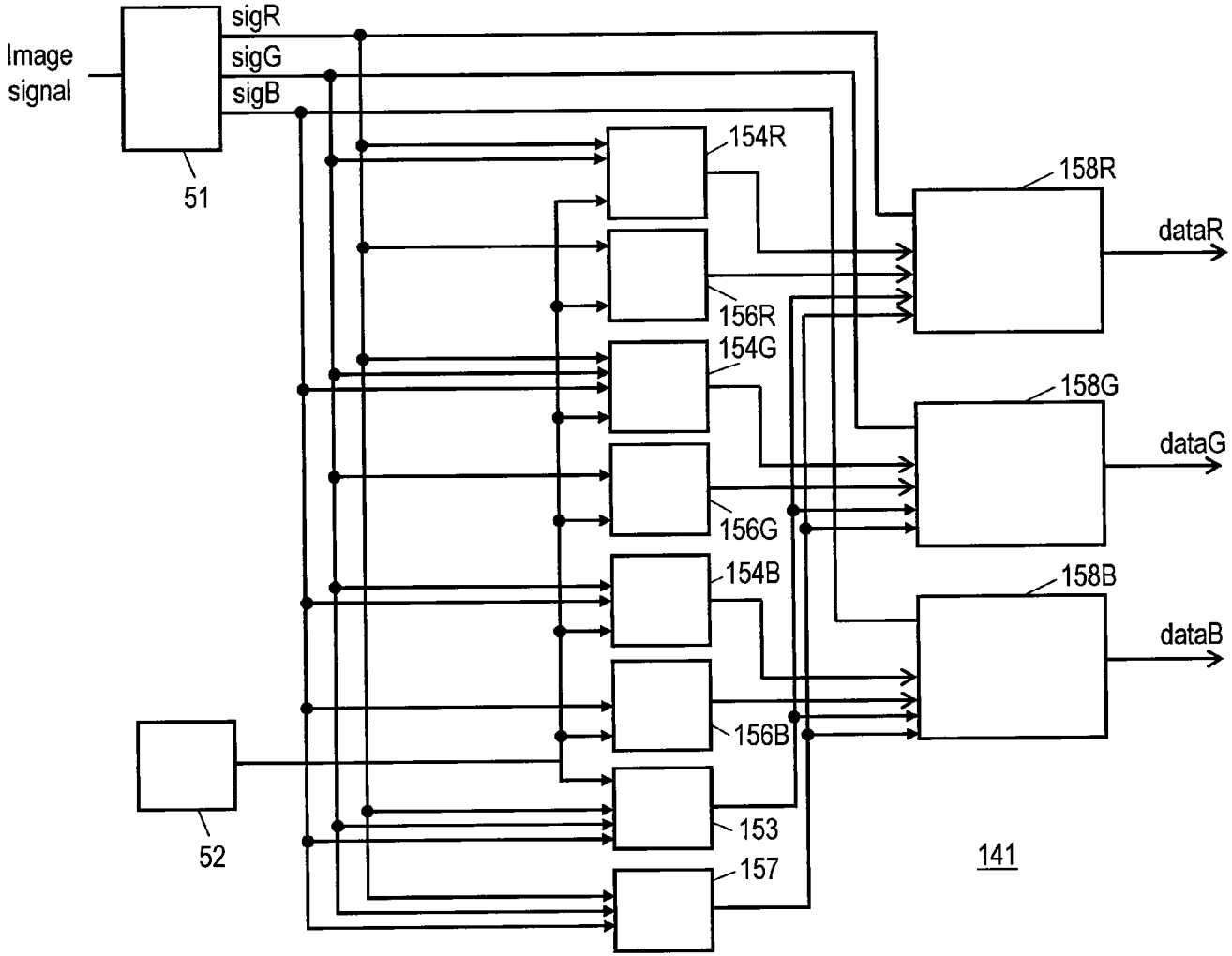
FIG. 13 is a circuit block diagram showing the detail of an image signal processing circuit of the plasma display device.

Next, the configuration of an image signal processing circuit of the second exemplary embodiment is described. FIG. 13 is a circuit block diagram showing the detail of image signal processing circuit 141 of plasma display device 40 in accordance with the second exemplary embodiment of the present invention. Image signal processing circuit 141 has color separating section 51, random number generating section 52, dark image detecting section 153, R comparing section 154R, G comparing section 154G, B comparing section 154B, R differential section 156R, G differential section 156G, B differential section 156B, motion detecting section 157, R data converting section 158R, G data converting section 158G, and B data converting section 158B.

Color separating section 51 and random number generating section 52 are the same as color separating section 51 and random number generating section 52 of the first exemplary embodiment.

Dark image detecting section 153 determines luminance conversion signal sigY by multiplying each of red image signal sigR, green image signal sigG, and blue image signal sigB by a coefficient proportional to the luminance. Dark image detecting section 153 selects one from candidates "20", "18", "16", and "14" for constant BRT based on the random number generated by random number generating section 52. Dark image detecting section 153 compares luminance conversion signal sigY with constant BRT, and outputs the comparison result of either of dark image and bright image to R data converting section 158R, G data converting section 158G, and B data converting section 158B.

R comparing section 154R, based on the random number generated by random number generating section 52, selects one from candidate numerical values "1.6", "1.5", "1.4", and "1.3" for constant Kr1 and selects one from candidate numerical values "0.8", "0.75", "0.7", and "0.65" for constant Kr2. R comparing section 154R compares red image signal sigR with constant Kr1 times green image signal sigG, red image signal sigR with constant Kr2 times green image signal sigG, and determines a relative signal level of red image signal sigR. Then, R comparing section 154R outputs a comparison result, namely high signal level, intermediate signal level, or low signal level, to R data converting section 158R.

G comparing section 154G and B comparing section 154B operate similarly to R comparing section 154R.

R differential section 156R, based on the random number generated by random number generating section 52, selects one from candidate numerical values "8.5", "8.0", "7.5", and "7.0" for constant Cr. R differential section 156R calculates spatial difference of red image signal sigR, uses constant Cr, and outputs a comparison result, namely large spatial difference or small spatial difference, to R data converting section 158R.

G differential section 156G and B differential section 156B operate similarly to R differential section 156R.

Motion detecting section 157 has frame memory and a differential circuit, for example. Motion detecting section 157 calculates the difference between frames, as the time difference. Motion detecting section 157 detects an image as moving image when the absolute value is a predetermined value or more, or detects the image as still image when the absolute value is smaller than the predetermined value. Motion detecting section 157 outputs the detection result to R data converting section 158R, G data converting section 158G, and B data converting section 158B.

R data converting section 158R converts red image signal sigR into red image data dataR using the coding tables shown in FIG. 10A, FIG. 10B, FIG. 10C, FIG. 10D, FIG. 10E, and FIG. 10F based on the following parameters: the detection result of dark image detecting section 153; the comparison result of R comparing section 154R; the result of spatial difference of R differential section 156R; and the motion detection result of motion detecting section 157. Similarly, G data converting section 158G converts green image signal sigG into green image data dataG, and B data converting section 158B converts blue image signal sigB into blue image data dataB.

Figure 14:
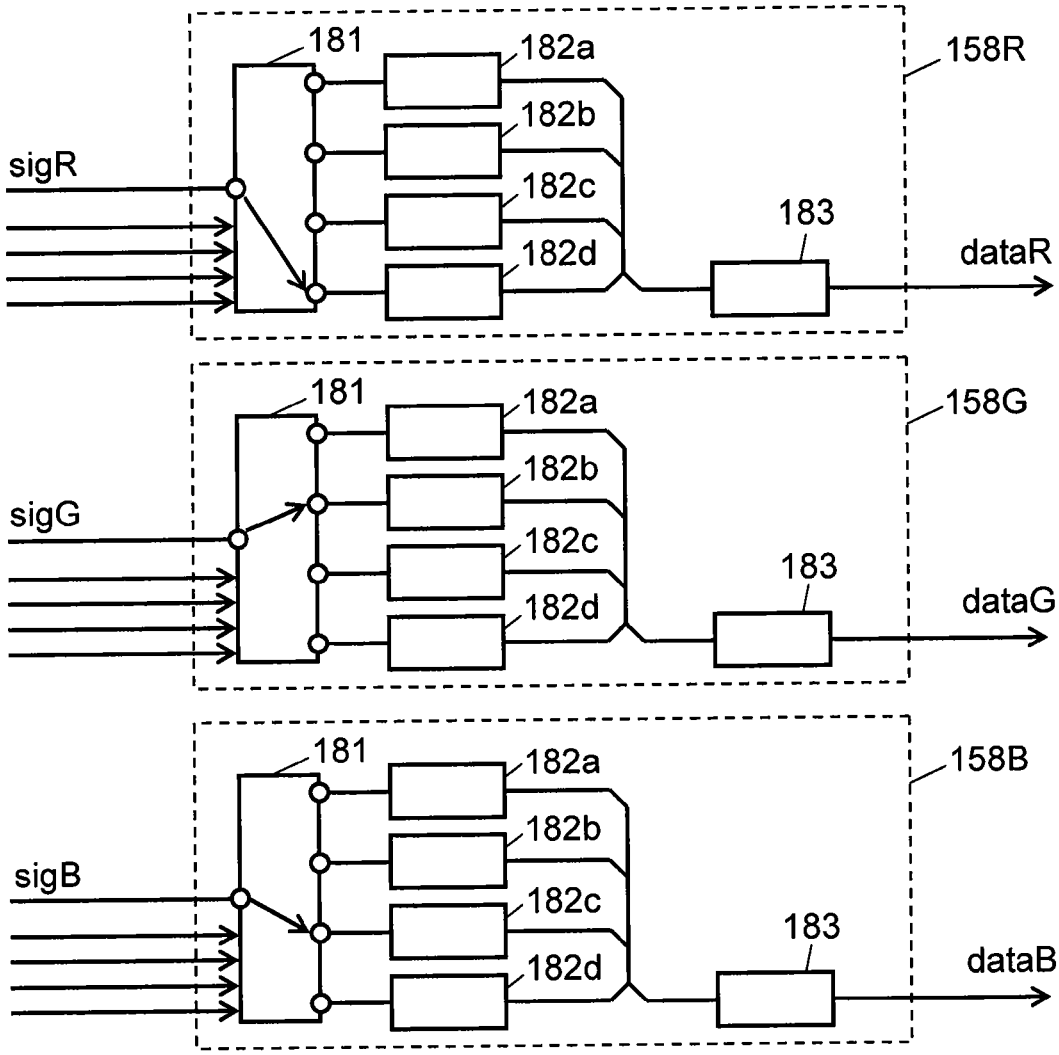
FIG. 14 is a circuit block diagram of an R data converting section, G data converting section, and B data converting section of the plasma display device.

FIG. 14 is a circuit block diagram of R data converting section 158R, G data converting section 158G, and B data converting section 158B of plasma display device 40 in accordance with the second exemplary embodiment of the present invention. R data converting section 158R has coding selecting section 181, four coding tables 182*a*, 182*b*, 182*c*, and 182*d*, and error diffusion processing section 183.

Coding selecting section 181 selects one from four coding tables 182*a*, 182*b*, 182*c*, and 182*d* based on the detection result of dark image detecting section 153, the comparison result of R comparing section 154R, the result of spatial difference of R differential section 156R, and the detection result of motion detecting section 157. Each of coding tables 182*a*, 182*b*, 182*c*, and 182*d* is constituted using a data converting table in an ROM or the like, and converts input red image signal sigR into red image data. Error diffusion processing section 183 is disposed for falsely displaying a gradation that cannot be displayed on the coding tables, applies error diffusion processing and dither processing to the red image data, and outputs the processed red image data as image data dataR.

G data converting section 158G and B data converting section 158B have a configuration similar to that of R data converting section 158R, and hence are not described.

In the second embodiment, constants Kr1, Kr2, Kg1, Kg2, Kb1, and Kb2 for determining the height of the signal level of an image signal, and constants Cr, Cg, and Cb for determining the degree of the spatial difference of the image signal are set while being probabilistically varied for each pixel, thereby diffusing the switching boundary between the used coding tables in a random fashion. However, the method of diffusing the boundary in a random fashion is not limited to this. One example of the method is described as a third exemplary embodiment.

(Third Exemplary Embodiment)

The configuration of image signal processing circuit 241 of the third exemplary embodiment differs from that of image signal processing circuit 141 of the second exemplary embodiment in R comparing section 254R, G comparing section 254G, and B comparing section 254B.

Figure 15:
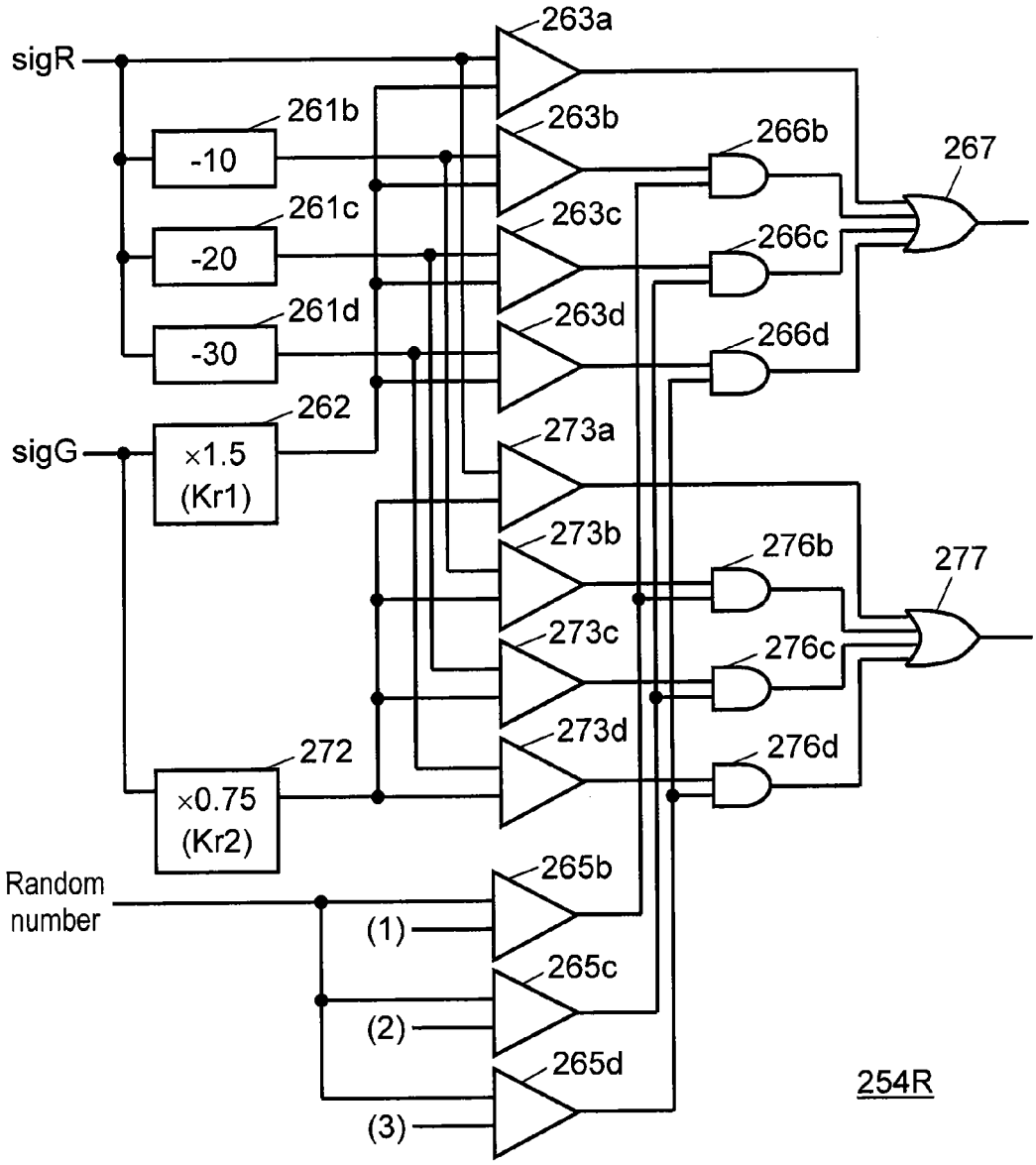
FIG. 15 is a circuit block diagram of an R comparing section of a plasma display device in accordance with a third exemplary embodiment of the present invention.

FIG. 15 is a circuit block diagram of R comparing section 254R of plasma display device 40 in accordance with the third exemplary embodiment of the present invention. R comparing section 254R has subtracters 261*b*, 261*c*, and 261*d*, multiplier 262, comparators 263*a*, 263*b*, 263*c*, and 263*d*, comparators 265*b*, 265*c*, and 265*d*, AND gates 266*b*, 266*c*, and 266*d*, OR gate 267, multiplier 272, comparators 273*a*, 273*b*, 273*c*, and 273*d*, AND gates 276*b*, 276*c*, and 276*d*, and OR gate 277.

Subtracter 261*b* subtracts "10" from red image signal sigR, subtracter 261*c* subtracts "20" from red image signal sigR, and subtracter 261*d* subtracts "30" from red image signal sigR. They output the subtraction results. Multiplier 262 multiplies green image signal sigG by constant Kr1. Comparator 263*a* compares red image signal sigR with constant Kr1 times green image signal sigG. Comparator 263*b* compares a signal obtained by subtracting "10" from red image signal sigR with constant Kr1 times green image signal sigG. Comparator 263*c* compares a signal obtained by subtracting "20" from red image signal sigR with constant Kr1 times green image signal sigG. Comparator 263*d* compares a signal obtained by subtracting "30" from red image signal sigR with constant Kr1 times green image signal sigG.

Comparator 265*b* compares the random number generated by random number generating section 52 with numerical value "1". The random number is one of "00", "01", "10", and "11" in binary of 2 bits, namely one of "0", "1", "2", and "3" in a decimal system. Therefore, the probability that the output of comparator 265*b* is "H" is ¾, and the probability that the output is "L" is ¼. Comparator 265*c* compares the random number generated by random number generating section 52 with numerical value "2". Therefore, the probability that the output of comparator 265*c* is "H" is ½, and the probability that the output is "L" is ½. Comparator 265*d* compares the random number generated by random number generating section 52 with numerical value "3". Therefore, the probability that the output of comparator 265*d* is "H" is ¼, and the probability that the output is "L" is ¾.

AND gate 266*b* outputs the logical product of the output of comparator 263*b* and the output of comparator 265*b*, AND gate 266*c* outputs the logical product of the output of comparator 263*c* and the output of comparator 265*c*, and AND gate 266*d* outputs the logical product of the output of comparator 263*d* and the output of comparator 265*d*. OR gate 267 outputs the logical addition of the outputs of AND gates 266*b*, 266*c*, and 266*d*.

Multiplier 272 multiplies green image signal sigG by constant Kr2. Comparators 273*a*, 273*b*, 273*c*, and 273*d*, AND gates 276*b*, 276*c*, and 276*d*, and OR gate 277 are similar to comparators 263*a*, 263*b*, 263*c*, and 263*d*, AND gates 266*b*, 266*c*, and 266*d*, and OR gate 267.

G comparing section 254G and B comparing section 254B operate similarly to R comparing section 254R.

Figure 16:
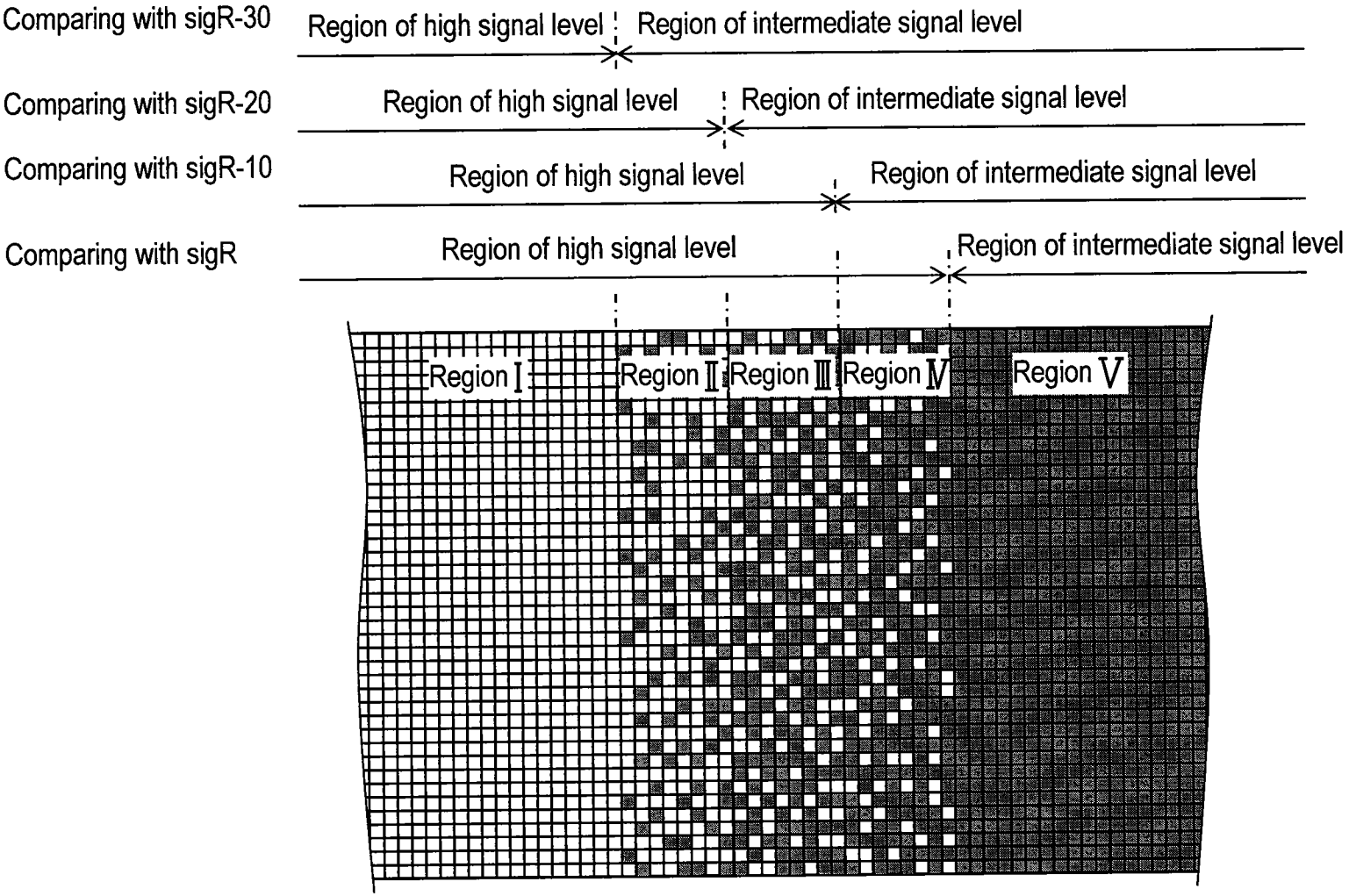
FIG. 16 is a schematic diagram showing a switching state between the coding tables of the plasma display device.

Next, the operation of R comparing section 254R is described. FIG. 16 is a schematic diagram showing a switching state between the coding tables of the plasma display device 40, and corresponds to FIG. 7 of the first exemplary embodiment. Similarly to the first exemplary embodiment, for example, FIG. 16 shows image signals of the following state: the signal levels of green image signals sigG are constant, and the signal levels of red image signals sigR are large on the left side and decrease toward the right side.

Comparator 263*a* compares red image signal sigR with "1.5" times green image signal sigG, determines high signal level and outputs "H" in region I, region II, region III, and region IV, and determines intermediate signal level and outputs "L" in region V. Comparator 263*b* compares a signal obtained by subtracting "10" from red image signal sigR with "1.5" times green image signal sigG, so that the region where high signal level is determined becomes small. Therefore, comparator 263*b* outputs "H" in region I, region II, and region III, and outputs "L" in region IV and region V. Comparator 263*c* compares a signal obtained by subtracting "20" from red image signal sigR with "1.5" times green image signal sigG, so that the region where high signal level is determined further becomes small. Therefore, comparator 263*c* outputs "H" in region I and region II, and outputs "L" in region III, region IV, and region V. Comparator 263*d* compares a signal obtained by subtracting "30" from red image signal sigR with "1.5" times green image signal sigG, and hence outputs "H" in region I, and outputs "L" in region II, region III, region IV and region V.

On the other hand, comparator 265*b* outputs "H" in the probability of ¾ and "L" in the probability of ¼. Comparator 265*c* outputs "H" in the probability of ¾ and "L" in the probability of ¾. Comparator 265*d* outputs "H" in the probability of ¼ and "L" in the probability of ¾.

As a result, the determination result of R comparing section 254R is intermediate signal level for the pixels in region V regardless of the value of the random number. For the pixels in region IV, intermediate signal level is determined in the probability of ¾, and high signal level is determined in the probability of ¼. For the pixels in region III, intermediate signal level is determined in the probability of ½, and high signal level is determined in the probability of ½. For the pixels in region II, intermediate signal level is determined in the probability of ¼, and high signal level is determined in the probability of ¾.

In the third exemplary embodiment, as a method of adding the disturbance based on the random number to the determined selection reference, the disturbance is added to the signal level of the image signal of each color. Also in the third exemplary embodiment, three transition regions II, III, and IV can be disposed between region I using the first coding table and region V using the second coding table. The transition regions where the discharge cells for controlling the light emission or no light emission using each coding table are probabilistically distributed are disposed in the switching boundary between the coding tables, and thus coding tables can be switched smoothly.

The number of coding table is four in the second exemplary embodiment; however the present invention is not limited to this. A plurality of other coding tables may be switched and used.

In the present invention, the number of subfield and luminance weight of each subfield are not limited to the above-mentioned values. The specific numerical values or the like used in the above-mentioned exemplary embodiments are simply one example, and are preferably set to the optimal values according to the characteristic of the panel or the specification of the plasma display device.

Industrial Applicability

The present invention can reduce the power consumption of a data electrode driving circuit without sacrificing the image display quality, and hence is useful as a driving method of a plasma display device.

REFERENCE MARKS IN THE DRAWINGS

10 panel
22 scan electrode
23 sustain electrode
24 display electrode pair
32 data electrode
40 plasma display device
41, 141, 241 image signal processing circuit
42 data electrode driving circuit
43 scan electrode driving circuit
44 sustain electrode driving circuit
45 timing generating circuit
51 color separating section
52 random number generating section
54R, 154R, 254R R comparing section
54G, 154G, 254G G comparing section
54B, 154B, 254B B comparing section
58R, 158R R data converting section
58G, 158G G data converting section
58B, 158B B data converting section
61 selector
62 multiplier
63, 263*a*, 263*b*, 263*c*, 263*d*, 265*b*, 265*c*, 265*d*, 273*a*, 273*b*, 273*c*, 273*d* comparator
81,181 coding selecting section
82*a*, 82*b*, 182*a*, 182*b*, 182*c*, 182*d* coding table
153 dark image detecting section
156R R differential section
156G G differential section
156B B differential section
157 motion detecting section
183 error diffusion processing section
261*b*, 261*c*, 261*d* subtracter
262, 272 multiplier
266*b*, 266*c*, 266*d*, 276*b*, 276*c*, 276*d* AND gate
267, 277 OR gate
sigB blue image signal
sigG green image signal
sigR red image signal The invention clamed is:

1. A driving method of a plasma display device comprising:

constituting one field period by a plurality of subfields of a predetermined luminance weight;

selecting a plurality of combinations from arbitrary combinations of the subfields and creating a combination set for display; and displaying gradation by controlling light emission or no light emission in a discharge cell using a combination of the subfields belonging to the combination set for display, wherein a plurality of combination sets for display having a different number of combinations is provided, and a random number generating section for generating a random number is provided, wherein a combination set for display is used for each of a red image signal, a green image signal, and a blue image signal, the combination set for display being selected from the plurality of combination sets for display based on a predetermined selection reference, and wherein disturbance based on the random number is added to the predetermined selection reference.

2. The driving method of the plasma display device of claim 1, wherein the predetermined selection reference for the red image signal is a ratio of a signal level of the red image signal to a signal level of the green image signal.

3. The driving method of the plasma display device of claim 1, wherein the predetermined selection reference for the green image signal is a ratio of a signal level of the green image signal to a higher one of the signal levels of the red image signal and the blue image signal.

4. The driving method of the plasma display device of claim 1, wherein the predetermined selection reference for the blue image signal is a ratio of a signal level of the blue image signal to a signal level of the green image signal.

5. The driving method of the plasma display device of claim 1, wherein the predetermined selection reference for the image signal of each color, of the red image signal, the green image signal, and the blue image signal, is a ratio of an absolute value of spatial difference for the image signal of the color to a signal level of the image signal of the color.

6. The driving method of the plasma display device of claim 1, wherein the average value of hamming distances between certain gradations and the next smaller gradations in a combination set for display that has a small number of combinations is smaller than the average value of hamming distances between certain gradations and the next smaller gradations in a combination set for display that has a large number of combinations.

* * * * *